US008611799B2

(12) United States Patent
Mitsui et al.

(10) Patent No.: US 8,611,799 B2
(45) Date of Patent: Dec. 17, 2013

(54) ACHROMATIC APPARATUS FOR ACHROMATIZING ACHROMATIC TONER IMAGE FORMED ON RECORDING MEDIUM

(75) Inventors: Satoshi Mitsui, Tokyo (JP); Katsumi Maeda, Ome (JP); Yoiti Tamagawa, Fussa (JP)

(73) Assignees: Casio Electronics Manufacturing Co., Ltd., Saitama (JP); Casio Computer Co., Ltd., Tokyo (JP)

( * ) Notice: Subject to any disclaimer, the term of this patent is extended or adjusted under 35 U.S.C. 154(b) by 144 days.

(21) Appl. No.: 13/187,165

(22) Filed: Jul. 20, 2011

(65) Prior Publication Data

US 2012/0020707 A1 Jan. 26, 2012

(30) Foreign Application Priority Data

Jul. 21, 2010 (JP) ..... 2010-163464
Aug. 9, 2010 (JP) ..... 2010-178770
Dec. 6, 2010 (JP) ..... 2010-271130
Dec. 14, 2010 (JP) ..... 2010-277836

(51) Int. Cl.
*G03G 15/20* (2006.01)

(52) U.S. Cl.
USPC ..... 399/320

(58) Field of Classification Search
USPC ..... 399/320, 67, 69, 329; 392/376
See application file for complete search history.

(56) References Cited

U.S. PATENT DOCUMENTS 2,315,124 A * 3/1943 Luzius ..... 34/240
3,499,231 A * 3/1970 Mullaney ..... 34/553
4,789,773 A * 12/1988 Mikschl ..... 219/461.1
5,572,311 A * 11/1996 Abe et al. ..... 399/127
7,029,833 B2 * 4/2006 Takahashi et al. ..... 430/333
7,632,945 B2 12/2009 Shinpo et al.
2009/0154970 A1 6/2009 Yoshida et al.
2012/0145023 A1 6/2012 Yoshida et al.

FOREIGN PATENT DOCUMENTS

JP 05-204278 A 8/1993
JP 06-208317 * 7/1994
JP 06208317 A * 7/1994

(Continued)

OTHER PUBLICATIONS

JP 06208317A Machine Translation.*

(Continued)

*Primary Examiner* — Clayton E Laballe
*Assistant Examiner* — Victor Verbitsky
(74) *Attorney, Agent, or Firm* — Holtz, Holtz, Goodman & Chick, PC

(57) ABSTRACT

An achromatic apparatus achromatizing an achromatic toner image on paper by an achromatic toner containing a near-infrared ray absorbing colorant that is a cyanine-based colorant, and an organic boron-based compound includes heater units each of which are a ceramic heater arranged across an achromatic convey path of an achromatic unit, and light source units each of which include an LED array chip having a center wavelength shifted to the long-wavelength side from the peak of the first absorption band of the near-infrared ray absorbing colorant and within a predetermined wavelength range. While the paper formed with the achromatic toner image is being conveyed through the achromatic convey path at a liner speed of equal to or faster than 15 mm/sec, the achromatic toner image is heated to a predetermined temperature, and is irradiated with achromatic light from the LED, and thus achromatized efficiently at a low energy consumption.

11 Claims, 17 Drawing Sheets

(56) References Cited

FOREIGN PATENT DOCUMENTS

| | | | |
|---|---|---|---|
| JP | 06-266044 | A | 9/1994 |
| JP | 06-332339 | A | 12/1994 |
| JP | 07-049634 | A | 2/1995 |
| JP | 07-072763 | A | 3/1995 |
| JP | 07-319346 | A | 12/1995 |
| JP | 08-152823 | A | 6/1996 |
| JP | 09-305074 | A | 11/1997 |
| JP | 2000-081816 | A | 3/2000 |
| JP | 2009-143231 | A | 7/2009 |
| WO | WO 2005/007753 | A1 | 1/2005 |

OTHER PUBLICATIONS

Japanese Office Action dated Jul. 9, 2013 (and English translation thereof) in counterpart Japanese Application No. 2010-178770.
Japanese Office Action dated Jul. 9, 2013 (and English translation thereof) in counterpart Japanese Application No. 2010-163464.

* cited by examiner

FIG. 11

| | SAMPLING DATA COMPARISON | | SIMILAR LINE COMPARISON | |
|---|---|---|---|---|
| | R-L* | R-ID | R-L* | R-ID |
| -10nm | 0.34 | -0.33 | 0.39 | -0.35 |
| 0nm | 0.45 | -0.46 | 0.52 | -0.51 |
| +10nm | 0.54 | -0.56 | 0.59 | -0.60 |
| +20nm | 0.53 | -0.56 | 0.57 | -0.59 |
| +30nm | 0.52 | -0.54 | 0.53 | -0.55 |
| +40nm | 0.47 | -0.50 | 0.50 | -0.52 |
| +50nm | 0.45 | -0.47 | 0.47 | -0.49 |
| +60nm | 0.39 | -0.41 | 0.41 | -0.42 |

ACHROMATIC APPARATUS FOR ACHROMATIZING ACHROMATIC TONER IMAGE FORMED ON RECORDING MEDIUM

CROSS-REFERENCE TO RELATED APPLICATION

This application claims the benefit of Japanese Patent Applications No. 2010-163464 filed on Jul. 21, 2010, No. 2010-178770 filed on Aug. 9, 2010, No. 2010-271130 filed on Dec. 6, 2010 and No. 2010-277836 filed on Dec. 14, 2010, the entire disclosure of which is incorporated by reference herein.

FIELD

This application relates generally to an achromatic apparatus that achromatizes an achromatic toner image formed on a recording medium by an achromatic toner containing a near-infrared ray absorbing colorant including a cyanine-based colorant and an organic boron-based compound, and more particularly, to an chromatic apparatus that achromatizes the achromatic toner image at low energy consumption under an optimized achromatic condition.

BACKGROUND

Recently, saving of paper resources is a part of the global environmental protection. Regarding saving and reuse of paper resources through image forming apparatuses, the effective use of the rear face of a piece of paper having a front face printed is generally accepted in the society. Moreover, it is general that used paper is collected as a material of paper, and is used again as recycled paper.

According to the reuse of paper having one face printed, however, the number of reuse is limited to one time. Moreover, when the used paper is reused as a material, collection itself needs an effort and a cost, and processing of the material also needs an effort.

Hence, various schemes have been proposed which make the paper reusable in multiple times in an office. In order to reuse paper on which an image is once formed by a toner image as a paper resource, there is an idea of physically eliminating or optically achromatizing the image formed on the paper formed by the toner in order to make the paper reusable.

Regarding physical elimination of the image in order to make the paper reusable, there are a technique of applying a processing liquid that eliminates the toner on the image-formed face of the paper and of heating it in order to dissolve the toner, thereby eliminating the image, and a technique of sanding the image-formed face of the paper in order to scrape the toner image. However, those techniques need a time and an effort, and the paper to be reused is often damaged.

There is also a technique of using a thermo-sensitive achromatic agent and of causing a heating-oven-type achromatic apparatus to perform achromatizing. Moreover, there is known a technique of eliminating an achromatic toner using partial optical energy. When those achromatic apparatuses are installed in an office, however, the achromatic apparatus in addition to a printing apparatus like a printer needs additional power, and additional installation space, so that it is not economical.

Moreover, most achromatic apparatuses need much time for achromatizing, which are not user-friendly to users, and are not convenient thereto. In consideration of such a problem, it is desirable that the achromatic apparatus should be built in another device like a printer, and such another device should be capable of printing using an achromatic toner and of achromatizing thereof in addition to a normal printing.

Unexamined Japanese Patent Application KOKAI Publication No. H08-152823 discloses an image forming apparatus that has a function of performing printing on recording paper through development, transferring and fixing with an achromatic toner, and a function of emitting light for achromatizing to characters and images of the achromatic toner printed on the recording paper and of performing achromatizing.

In addition, various examples of achromatic toner and achromatic apparatus are proposed and Unexamined Japanese Patent Application KOKAI Publication No. H05-204278 discloses an apparatus which heats a toner image with a sensitizing colorant that can be achromatized by infrared ray and a boron-based compound, and which performs achromatizing with infrared, thereby remarkably improving the achromatizing speed.

According to this apparatus, effective light sources as the achromatic light source are halogen, flash, and LED (Light Emitting Diode) lamps, and in particular, examples using the halogen lamp are mainly disclosed. The halogen lamp is also used as a heat source since it emits energy in the long-wavelength range which is typical of far-infrared ray. As far as the heat-source is concerned, it is disclosed that the heat source is effective for the purpose of assisting an achromatic reaction.

Moreover, Unexamined Japanese Patent Application KOKAI Publication No. H07-049634 discloses a configuration in which a fixing device at the time of image formation and an achromatic device for achromatizing are common devices, a thermal roller pair of the fixing device at the time of image formation is also used as a heating unit at the time of achromatizing, and a light source for emitting achromatic light is arranged at the downstream side of the thermal roller pair in the fixing device based on the technology that the achromatic action becomes effective if a toner image is heated in advance and is irradiated with achromatic light in order to achromatize the toner image.

According to the related art disclosed in Unexamined Japanese Patent Application KOKAI Publication No. H08-152823, the effectiveness of the printer is demonstrated which has an achromatic device and a printing device integrated together and which performs achromatizing and printing through the same device. In this case, however, it is desirable to reduce the total power consumption including the power consumption by an achromatic unit in addition to the power consumption by the printer main body. The issue of power consumption is not disclosed in Unexamined Japanese Patent Application KOKAI Publication No. H08-152823.

Moreover, according to the related art disclosed in Unexamined Japanese Patent Application KOKAI Publication No. H07-049634, the halogen lamp emits light including not only near-infrared ray but also rays in the ultraviolet range, the visible light range, and from near-infrared range to far-infrared range. Hence, energies with not only absorption wavelength of the sensitizing colorant but also other excessive wavelengths which do not contribute to an achromatic reaction are emitted, so that it is not an economical energy source.

Unexamined Japanese Patent Application KOKAI Publication No. H07-049634 discloses the effectiveness of light emission with a resin being heated to a temperature equal to or higher than the glass transition temperature Tg, but in the case of heating using the halogen lamp, when the lamp is installed linearly relative to the paper passing through the convey path, the filament of the halogen lamp needs to increase the length thereof, and the power consumption becomes large inevitably, so that is is not always a good scheme from the standpoint of power consumption.

Furthermore, when the halogen lamp is used, such a lamp is always turned on at the time of achromatizing. Since the lamp itself is a consumable item which is broken down for several thousand hours, the running cost becomes large.

Regarding the light source other than the halogen lamp, an LED, etc., as an example light source is disclosed, but there is no disclosure about the setting of the light source under a specific achromatic condition. Moreover, regarding the combination of such light source with the achromatic toner, there is no proposal for a more effective optical energy, so that a relationship between appropriate light and an effective achromatic action of the colorant is still unclear.

In the case of a combination in which two devices: an LED lamp; and a heating device are combined together, there is an unignorable problem that is heat loss due to convection, irradiation, and thermal conduction by the heating device. However, the achromatic apparatus disclosed in Unexamined Japanese Patent Application KOKAI Publication No. H05-204278 and having both infrared ray generating device and heating device combined together is not configured in consideration of the heat-loss problem due to convection, irradiation and thermal conduction by the heating device. Accordingly, a task of reducing power consumption originating from such heat loss, etc., is not disclosed or suggested in Unexamined Japanese Patent Application KOKAI Publication No. H05-204278.

Conversely, as explained above, Unexamined Japanese Patent Application KOKAI Publication No. H07-049634 discloses the effectiveness of light emission with the resin being heated to a temperature equal to or higher than the glass transition temperature Tg. In order to increase the temperature of the toner to, for example, around 140 degrees Celsius which is higher than the glass transition temperature Tg, it is effective for achromatizing the toner image if the paper is irradiated with achromatic light when the temperature of the paper surface is substantially 200 degrees Celsius. However, if the paper is heated to the temperature of substantially 200 degrees Celsius for a long time, the paper may change the color thereof.

In this case, it is possible to achromatize the toner image while suppressing the color-change of the paper in accordance with the setting, such as the convey speed of the paper and the heating range, but a failure, such as paper jamming, turning off of the device power source, or a false operation of the switch may occur.

When such a failure occurs and the paper stopping at the heating unit in the achromatizing operation is left for a certain time, the paper changes the color thereof, which possesses a risk of smoking.

Hence, when a failure that the paper is stopping at the heating unit occurs, it is necessary to immediately terminate heating of the paper, and in general, a heater that is the heat source is turned off.

However, in order to set the surface temperature of the paper being conveyed to substantially 200 degrees Celsius, the temperature of the heater is set to be a further higher temperature. Accordingly, even if the heater is turned off, the temperature of radiation heat does not immediately decrease, in fact, the surface temperature of the paper increases and the color change of the paper advances.

When the failure is paper jamming, the jammed paper partially rises, and may be located closely to or contact the heat radiation surface of the heater. In this case, it easily brings about smoking from the paper.

SUMMARY

The present invention has been made in view of the above-explained circumstances, and it is a first object of the present invention to provide an achromatic apparatus which can perform achromatizing an achromatic toner image at a low energy consumption under an optimized achromatic condition.

Moreover, it is a second object of the present invention to provide an achromatic apparatus which can suppress heat loss due to convection, irradiation and thermal conduction at minimum, and which is effective for reduction of power consumption, i.e., low power consumption.

Furthermore, it is a third object of the present invention to provide an achromatic apparatus equipped with a heat-source release mechanism which can disable radiation heat from a heat source instantaneously when paper jamming, blackout, and other failures occur during an achromatizing operation and which can avoid color change and smoking of a piece of paper due to a continuous heat radiation.

In order to achieve the above object, a first aspect of the present invention provides an achromatic apparatus including an achromatic unit that includes, in order to achromatize an achromatic toner image formed on a recording medium using an achromatic toner, a heating unit and a light emitting unit, the achromatic toner comprising a near-infrared ray absorbing colorant which is a cyanine-based colorant, and an organic boron-based compound, in which the achromatic unit includes an achromatic convey path where the recording medium formed with the achromatic toner image is conveyed at a predetermined speed, the heating unit includes a heater that heats the achromatic toner image on the recording medium conveyed through the achromatic convey path to a temperature for effective achromatization of the achromatic toner image, and the light emitting unit includes an LED array chip as an achromatic light source having a center wavelength within a wavelength range from 820 to 850 nm.

According to the achromatic apparatus of the present invention employing the above-explained configuration, for example, the heater of the heating unit is a ceramic heater which heats the achromatic toner image on the recording medium conveyed through the achromatic convey path to a temperature of about 140 degrees Celsius. Moreover, the center frequency of the LED array chip that is the achromatic light source is shifted to a long-wavelength side from a peak of a first absorption band of the near-infrared ray absorbing colorant. Furthermore, the achromatic apparatus further includes a convey unit that conveys the recording medium through the achromatic convey path at a linear speed of equal to or faster than 15 mm/sec. Still further, a plurality of achromatic heat sources as the heater and a plurality of achromatic light sources are respectively arranged so as to face with one another across the achromatic convey path, and the achromatic apparatus is configured to achromatize the achromatic toner images formed on both surfaces of the recording medium.

In order to achieve the above object, a second aspect of the present invention provides an achromatic apparatus that includes: heat radiation heaters which are arranged across an achromatic convey path that conveys a recording medium at a predetermined speed in order to achromatize achromatic tone images formed on both surfaces of the recording medium, and which heat surfaces where the achromatic toner images are respectively formed; an achromatic light source that emits achromatic light to the surface where the achromatic toner image is formed, and which is heated by the heat radiation heater; a first heat-insulating member that thermally shields portions of the heat radiation heater other than a heat radiation plane thereof; a second heat-insulating member that shields a surrounding other than a surrounding of a region where emitted achromatic light from the achromatic light source passes among a surrounding of an achromatic region irradiated with heat radiation from the heat radiation heater and achromatic light from the achromatic light source; and a heat-resistant translucent glass plate which is provided to the surrounding of the region where the emitted achromatic light from the achromatic light source passes, and which thermally shields the achromatic region from the exterior together with the second heat-insulating member.

According to the achromatic apparatus employing the above-explained configuration, for example, the achromatic light source includes an LED array chip having a center wavelength within a wavelength range from 820 to 850 nm, and causes the LED array chip to emit light to the achromatic toner image heated to a temperature of around 140 degrees Celsius on the recording medium being conveyed through the achromatic convey path.

According to the achromatic apparatus employing the above-explained configuration, for example, the first heat-insulating member is formed of a nonorganic fiber-based heat-insulating material, and is firmly applied to an external surface of the heat source other than the heat radiation plane so as to surround the heat source. Moreover, the second heat-insulating member is formed of a tabular member that is a nonorganic fiber-based heat-insulating material.

In order to achieve the above-object, a third aspect of the present invention provides an achromatic apparatus that includes: a heat radiation heater which is located in a vicinity of an achromatic convey path that conveys a recording medium at a predetermined speed in order to achromatize an achromatic toner image formed on the recording medium, arranged obliquely to a direction in which the recording medium is conveyed so that one end of the heat radiation heater is closer to the achromatic convey path and an other end of the heat radiation heater is distant from the achromatic convey path, and heats a surface of the recording medium where the achromatic toner image is formed; an achromatic light source which is arranged so as to be close to the other end of the heat radiation heater and in a vicinity of the achromatic convey path, and which obliquely emits, from the other end side of the heat radiation heater, achromatic light to the surface of the recording medium where the achromatic toner image is formed and which is being heated by the heat radiation heater; a support shaft that supports the heat radiation heater; and a support shaft rotating unit which rotates and controls the support shaft and rotates the heat radiation heater so that a heat radiation plane of the heat radiation heater is directed in a different direction from a plane of the achromatic convey path when a defect that disables continuation of an achromatic process occurs while the recording medium is being heated by the heat radiation heater through the achromatic convey path.

According to the achromatic apparatus employing the above-explained configuration, for example, the defect includes a paper jamming, a blackout, and a false operation of a power cut switch. Moreover, the support shaft supports the heat radiation heater at a position toward the other end side rather than a center of the heat radiation heater, and the support shaft rotating unit rotates the support shaft so that a rotation trajectory of the other end of the heat radiation heater draws an arc along the achromatic convey path and the heat radiation plane is directed to an opposite side to the achromatic convey path when the defect occurs.

As explained above, the achromatic apparatus of the present invention can perform achromatizing an achromatic toner image under an optimized achromatic condition at a low energy consumption. Moreover, an apparatus which can suppress heat loss due to convection, radiation, and thermal conduction as minimum as possible, and is effective for reduction of power consumption, i.e., a low-power-consumption apparatus is provided. Furthermore, there is an effect that an apparatus is provided which can instantaneously disable heat radiation from the heat source when a defect like a paper jamming or a blackout occurs and which can avoid the color change of the paper and smoking thereof due to the continuation of heat radiation.

BRIEF DESCRIPTION OF THE DRAWINGS

A more complete understanding of this application can be obtained when the following detailed description is considered in conjunction with the following drawings, in which:

FIG. 11 is a diagram showing a rate how much a near-infrared ray absorbing colorant and an achromatic wavelength are shifted at the long-wavelength side obtained based on a correlation coefficient;

DETAILED DESCRIPTION

Embodiments of the present invention will be explained in detail with reference to the accompanying drawings.

[First Embodiment]

<Production Method of Achromatic Toner>

Figure 17A:
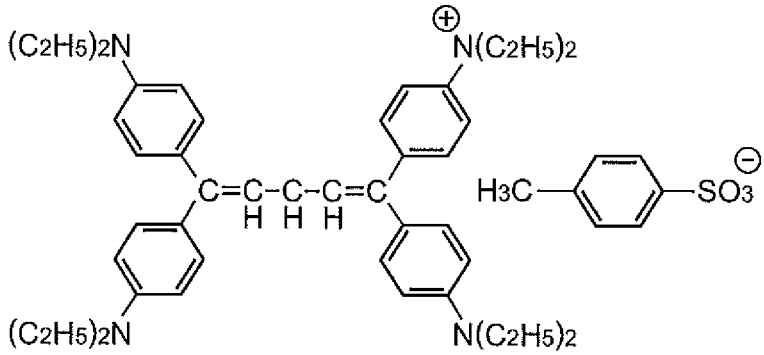
FIG. 17A (PRIOR ART)
FIG. 17A is a diagram showing a structural formula of a near-infrared ray absorbing colorant in an achromatic toner according to the present invention.
Figure 17B:
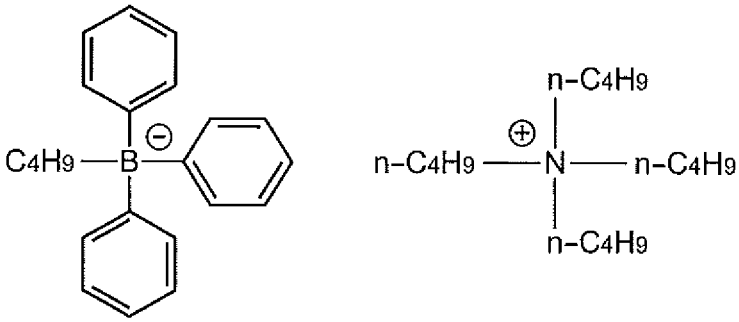
FIG. 17B (PRIOR ART)
FIG. 17B is a diagram showing the structural formula of an achromatic agent (organic boron-based compound) in the achromatic toner according to the present invention.

First, an explanation will be given of a first embodiment of the present invention which relates to a production method of an achromatic toner used in the present invention. At first, 1.5 pts. mass of a cyanine-based near-infrared ray absorbing colorant "IRT" (made by SHOWA DENKO K.K., see the structural formula shown in FIG. 17A) having a sensitivity at a wavelength of 817 nm, 4 pts. mass of an organic boron-based compound "P3B" (made by SHOWA DENKO K.K., see the structural formula shown in FIG. 17B), 90.5 pts. mass of a toner polyester binding agent (made by KAO Corporation), 1.5 pts. mass of a negative charge adjuster "LR-147" (made by Japan Carlit Corporation), and 2.5 pts. mass of a carnauba WAX No. 1 powder (made by S. KATO & Co.,) are put in a Henschel mixer (made by MITSUI Corks) and mixed together.

Next, the above mixed material is dissolved and kneaded. The obtained kneaded material is coarsely grained by a roatplex (made by HOSOKAWA Micron Group) in order to obtain a coarsely grained material. The obtained coarsely grained material is further grained by a collisional grinding mill IDS (made by NIPPON Pneumatic MFG. Co., Ltd.,) and a classifier DSX (made by NIPPON Pneumatic MFG. Co., Ltd.,) so that the average grain diameter becomes 9 μm.

1 pts. mass of hydrophobic silica "R972" (made by NIPPON Aerosil Co., Ltd.,) is added, as an external additive, to 100 pts. mass of the powders obtained through the grinding, and those are mixed by the Henschel mixer, thereby obtaining an achromatic toner R.

[Second Embodiment]

<Achromatic-Function Image Forming Apparatus Equipped with Achromatic Apparatus>

Figure 1:
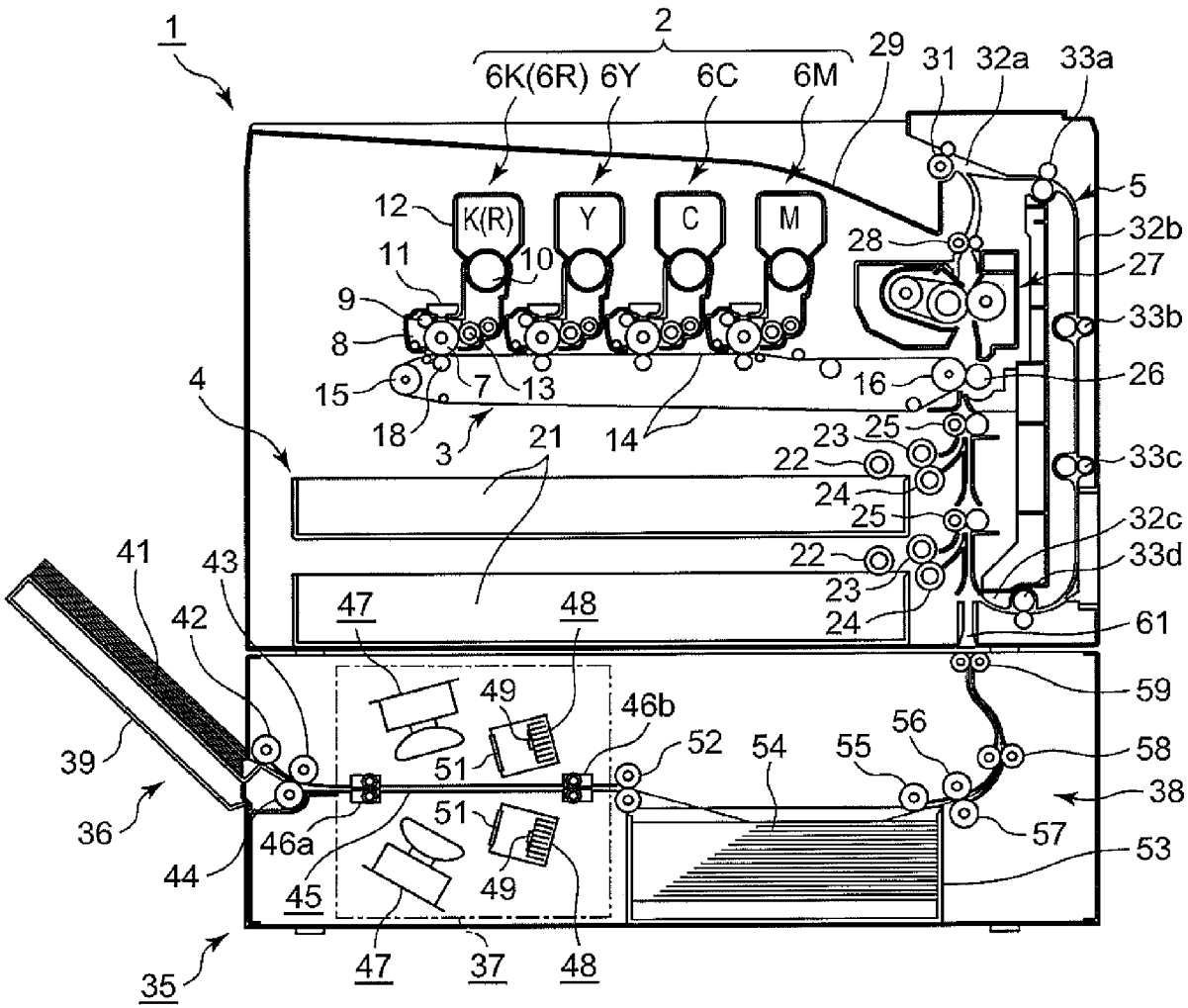
FIG. 1 is a cross-sectional view exemplarily showing the internal configuration of an achromatic-function image forming apparatus equipped with an achromatic apparatus according to a second embodiment of the present invention.

FIG. 1 is a cross-sectional view exemplarily showing the internal configuration of an achromatic-function image forming apparatus (hereinafter, simply referred to as a printer) equipped with an achromatic apparatus according to the second embodiment. A printer 1 shown in FIG. 1 is a tandem color image forming apparatus of an electrophotographic type and of secondary transfer type, and includes an image forming unit 2, an intermediate transfer belt unit 3, a paper feeder 4, and a both-face printing convey unit 5.

The image forming unit 2 is configured by four image forming units 6 (6M, 6C, 6Y, and 6K (6R)) arranged side by side from the right to the left in the figure and in a multi-stage manner.

The image forming unit 6R is for the achromatic toner R obtained in the first embodiment, and can be replaceable with the image forming unit 6K for a black toner K. The image forming units 6M, 6C, and 6Y are for a magenta toner M, a cyan toner C, and a yellow toner Y, respectively.

When the image forming unit 6R is replaced with the image forming unit 6K, it is driven in solo or together with the three image forming units 6M, 6C, and 6Y of the color image forming unit 2. When the image forming unit 6R is used, it is driven in solo.

Respective image forming units 6 employ the same configuration except the color of a toner contained in a toner container. Hence, the explanation will be given of the configuration of the image forming unit 6K for black (K) as an example below.

The image forming unit 6 includes a photoreceptor drum 7 at the lowermost part thereof. The photoreceptor drum 7 has a circumference surface formed of, for example, an organic photoconductive material. Arranged around the photoreceptor drum 7 so as to contact or to be located near the circumference surface thereof are a cleaner 8, a charged roller 9, an optical writing head 11 and a development roller 13 of a developer 12.

The developer 12 has a toner container which is arranged at an upper portion thereof and which contains a developing agent (a toner) of any one of magenta (M), cyan (C), yellow (Y) and black (K) indicated by the symbols M, C, Y, and K in the figure, and also has, at a middle portion thereof, a toner supply mechanism 10 to a lower portion.

Moreover, the above-explained development roller 13 is provided at a side opening formed in the lower portion of the developer 12, and it is not illustrated in the figure but a toner stirring member, a tonner supply roller that supplies the toner to the development roller 13, and a doctor blade that restricts a toner layer on the development roller 13 to have a certain thickness are provided inside the developer 12.

The intermediate transfer belt unit 3 includes an endless intermediate transfer belt 14 that substantially runs from an end to an end from the left to the right of the figure at the center of the device main body as a flat loop, a belt driving roller 15 around which the intermediate transfer belt 14 is fastened and which moves and circulates the intermediate transfer belt 14 in the counterclockwise direction of the figure, and a follower roller 16.

The intermediate transfer belt unit 3 also includes a belt position control mechanism which is not illustrated in the figure and which is arranged inwardly of the loop by the flat and looped intermediate transfer belt 14. The belt position control mechanism includes primary transfer rollers 18 each of which is pressed against the lower circumference surface of the photoreceptor drum 7 through the intermediate transfer belt 14 and each of which is formed of a conductive foaming sponge.

The belt position control mechanism rotates and moves the three primary transfer rollers 18 corresponding to the three image forming units 6M, 6C, and 6Y of magenta (M), cyan (C), and yellow (Y) around respective support shafts in the same cycle.

The belt position control mechanism rotates and moves one primary transfer roller 18 corresponding to the image forming unit 6K of black (K) in a different rotation-movement cycle from those of the three primary transfer rollers 18 in order to move the intermediate transfer belt 14 apart from the photoreceptor drum 7.

That is, the belt position control mechanism is capable of changing the position of the intermediate transfer belt 14 of the intermediate transfer belt unit 3 in accordance with a full-color mode (all of the four primary transfer rollers 18 abut the intermediate transfer belt 14), a monochrome mode (only the primary transfer roller 18 corresponding to the image forming unit 6K abuts the intermediate transfer belt 14), and a fully non-transfer mode (all of the four primary transfer rollers 18 are moved apart from the intermediate transfer belt 14).

The intermediate transfer belt 14 has a belt surface where a toner image is directly transferred (primary transfer), and conveys the toner image to a transfer position to paper in order to further transfer (secondary transfer) the toner image to a recording medium (paper), so that the whole mechanism that transfers a toner image to paper is referred to as the intermediate transfer belt unit.

The paper feeder 4 includes two paper feeding cassettes 21 arranged up and down in a two-stage manner. Arranged in the vicinity of respective paper feeding openings (at the right of the figure) of the two paper feeding cassettes 21 are paper pickup rollers 22, paper supply rollers 23, handling rollers 24, and standby convey roller pairs 25, respectively.

A secondary transfer roller 26 that contacts and is pressed against the follower roller 16 through the intermediate transfer belt 14 is arranged in the paper convey direction (the upper vertical side) of the standby convey roller pairs 25, and the secondary transfer roller 26 configures a secondary transfer unit to the paper.

A belt-scheme fixing device 27 is arranged at the downstream side (the upper side in the figure) of the secondary transfer unit. Arranged further at the downstream side of the belt-scheme fixing device 27 are a carrying roller pair 28 that carries paper having undergone fixing from the belt-scheme fixing device 27, and a paper-ejecting roller pair 31 that ejects the carried paper to a paper-ejecting tray 29 formed on the upper face of the device.

The both-face printing convey unit 5 includes a start return path 32*a* running into the lateral rightward direction of the figure from the convey path of the middle portion between the carrying roller pair 28 and the paper-ejecting roller pair 31, an intermediate return path 32*b* bent downwardly from the start return path 32*a*, and a terminal return path 32*c* bent in the lateral leftward direction opposite to the above-explained direction in order to turn over return paper eventually.

Furthermore, the both-face printing convey unit 5 includes four pairs of return rollers 33*a*, 33*b*, 33*c*, and 33*d* arranged in the halfway of respective return paths. The exit of the terminal return path 32*c* is communicated with a convey path to the standby convey roller pairs 25 corresponding to the lower paper feeding cassette 21 of the paper feeding unit 4.

An achromatic apparatus 35 joined to the lower portion of the printer 1 includes a paper feeding unit 36, an achromatic unit 37, and an achromatized paper feeding unit 38. The paper feeding unit 36 includes a paper feeding cassette 39.

Plural pieces of papers 41 having achromatic toner image formed on respective surfaces are mounted on the paper feeding cassette 39. Arranged at the paper feeding opening of the paper feeding cassette 39 at the lower right end thereof is a paper feeding unit that includes a paper pickup roller 42, a supply roller 43, and a handling roller 44.

The paper 41 taken out by the paper feeding unit from the paper feeding cassette 39 one by one is fed to the achromatic unit 37. The achromatic unit 37 is provided with a convey mechanism mainly configured by an achromatic convey path 45.

Two pairs of paper convey rollers 46 (46*a* and 46*b*) which convey the paper 41 to the achromatic unit 37 and ejects the paper 41 therefrom are arranged at the start and the end of the achromatic convey path 45, respectively. Heater units 47 and light source units 48 for performing achromatizing an achromatic toner on both surfaces of the paper 41 are arranged above and under the achromatic convey path 45. It will be discussed later but the light source unit 48 includes an LED light source (a light source) 49 and a lens 51.

An ejecting roller pair 52 is arranged at the paper ejecting opening of the achromatic unit 37, and an achromatized paper retaining cassette 53 is freely detachably arranged at the downstream side of the ejecting roller pair 52. The achromatized paper retaining cassette 53 retains multiple pieces of achromatized paper 54.

Arranged at the paper feeding opening of the achromatized paper retaining cassette 53 at the upper right end thereof is a paper feeding unit that includes a paper pickup roller 55, a paper feeding roller 56, and a handling roller 57, and two convey roller pairs 58 and 59 are arranged at the downstream side of the paper feeding unit. Those roller groups configure the achromatized paper feeding unit 38.

The convey roller pair 59 at the terminal of the achromatized paper feeding unit 38 is communicated with a paper taking opening 61 of the main body of the printer 1 which is the convey destination. The paper taking opening 61 joins a convey path to the standby convey roller pairs 25 corresponding to the lower paper feeding cassette 21 and the terminal return path 32*c* of the both-face printing convey unit 5.

<Achromatic Convey Path>

When an achromatic toner image is printed on both surfaces of the paper 41, if the paper 41 is conveyed in the achromatic unit 37 by the belt convey mechanism in a regular fashion, toners melted by the heat for achromatizing stick to the belt.

Moreover, because heating to the paper is high temperature, the paper is rolled up, and may contact the heater unit 47. In addition, the paper may not enter the paper convey roller pairs 46*b* at the downstream side because of the roll-up of the paper, and may go out. Accordingly, a convey device configured in consideration of such concern is necessary.

Figure 2:
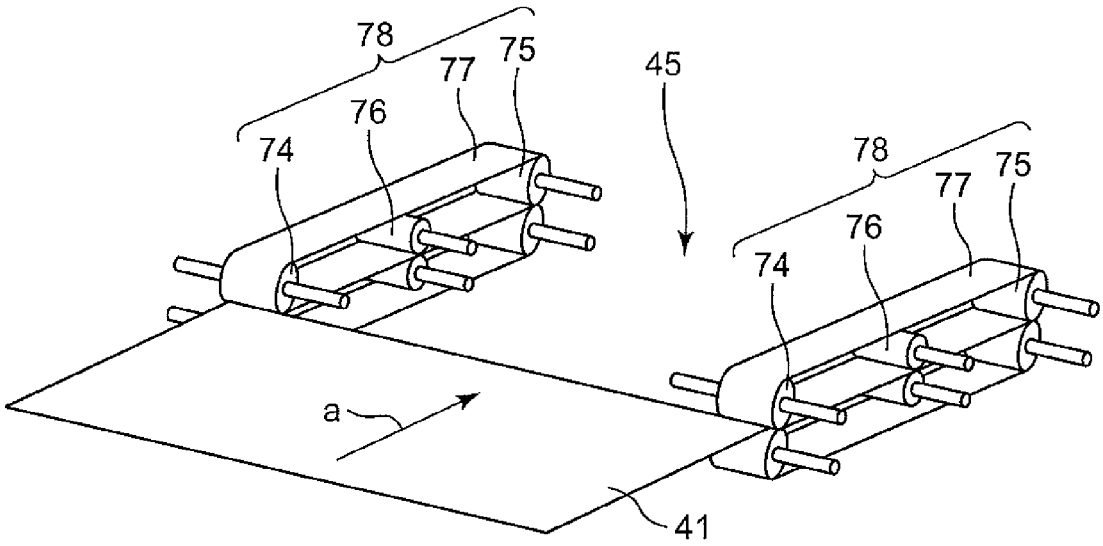
FIG. 2 is a perspective view showing a paper both-end convey device that configures a part of a convey mechanism of an achromatic unit according to the second embodiment of the present invention.

FIG. 2 is a perspective view showing a paper both-end convey device that is a part of the convey mechanism of the achromatic unit 37 according to the present invention. Illustration of the paper convey roller pairs 46*a* and 46*b* at the upstream side and the downstream side of the convey direction, respectively are omitted in the figure.

As shown in FIG. 2, arranged at both ends of the achromatic convey path 45 are paper both-end convey devices 78 each including two upper and lower stages each having a drive roller 74, a follower roller 75, a hold roller 76 and a thin belt 77 hung around the drive roller and the follower roller. As shown in the figure, the paper both-end convey devices 78 hold both ends of the paper 41 and convey the paper 41 in the direction indicated by an arrow a in the figure.

Figure 3:
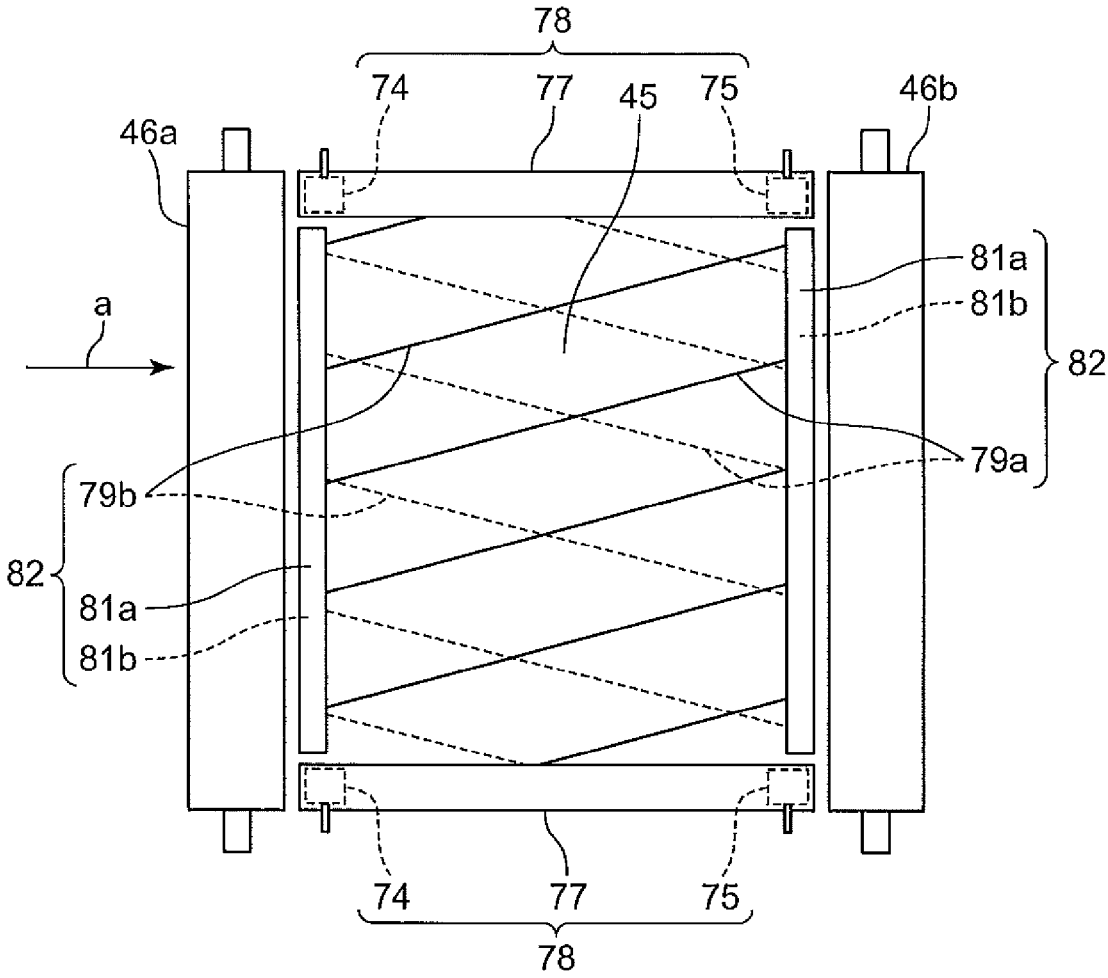
FIG. 3 is a plan view of the convey mechanism of the achromatic unit according to the second embodiment of the present invention.

FIG. 3 is a plan view of the convey mechanism of the achromatic unit 37. As shown in FIG. 3, put up above and under the paper 41 shown in FIG. 2 and conveyed by the paper convey roller pairs 46*a* and 46*b* and the paper both-end convey devices 78 are respective six wires 79 (79*a* and 79*b*) for preventing the paper from contacting the heater (upper wires are indicated by thick lines and the lower wires are indicated by dashed lines in the figure).

The heater-contact preventing wires 79*a* and 79*b* are held by wire holders 81 (81*a* and 81*b*), configure a heater-contact preventing mechanism 82, and are arranged so as to be fixed inside the achromatic unit 37.

Those heater-contact preventing wires 79 (79*a* and 79*b*) prevent the paper 41 from contacting a heat radiation heater to be discussed later, and suppress roll-up of the paper 41 from up and down, thereby preventing the paper 41 from going out from the paper both-end convey devices 78.

Those heater-contact preventing wires 79 are put up obliquely to the convey direction of the paper 41 and are spread at a wide pitch, so that those wires block substantially no achromatic radiation heat from the heat radiation heater to be discussed later and achromatic light emitted from an LED light source also to be discussed later.

According to the achromatic apparatus 35 having the above-explained configuration, if the achromatic apparatus 35 is configured to perform achromatizing an achromatic toner formed on only one surface of the paper 41, when the paper 41 is set in the paper feeding cassette 39, it is necessary to set and put an image surface subjected to achromatizing in either face-up or face-down manner, so that it is not convenient. According to the present embodiment, however, achromatizing can be performed on both surfaces simultaneously, so that it is convenient.

Regarding how to perform achromatizing an achromatic toner formed on both surfaces, a technique of performing achromatizing an achromatic toner formed on a one surface, of inverting the paper, and of performing achromatizing an achromatic toner formed on an other surface is possible like typical printers having a both-face printing mechanism. However, when achromatizing an achromatic toner image on a surface is performed after a heat necessary for achromatizing an achromatic toner is applied on the other surface, the achromatic ability may decrease.

That is, it is experimentally known that when achromatizing is performed on the image on one surface firstly, the image on the other surface is also heated, and the image on the other surface is cooled while the paper 41 is inverted by the both-face printing mechanism and conveyed, so that the achromatic ability decreases when achromatizing is performed on the other surface successively. Moreover, achromatizing is performed twice on the one surface and the other surface, respectively, so that achromatizing time becomes long.

Conversely, according to the present embodiment, achromatizing can be performed on both surfaces simultaneously, reduction of the achromatizing ability does not occur, and the good achromatic ability is maintained, so that the achromatizing time can be reduced to equal to or smaller than ½ of that of the case in which achromatizing is twice performed on the one surface and the other surface, respectively.

In the case of performing achromatizing an achromatic toner on only one surface, when the paper is heated from both sides, it can be heated efficiently since there is no energy loss due to thermal leakage from the other surface in the case of heating one surface only. Moreover, the set temperature of the heat radiation heater can be lowered, so that an effect of reducing the power consumption can be expected.

<Achromatic Heat Source and Achromatic Light Source>

Figure 4:
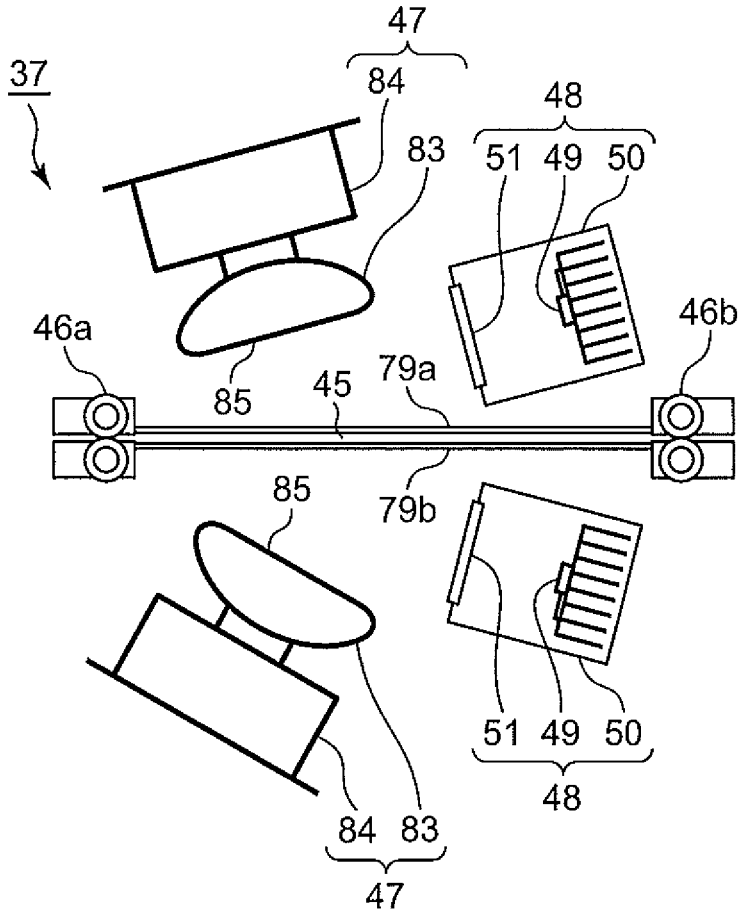
FIG. 4 is a diagram showing a basic configuration of the achromatic unit of the second embodiment of the present invention shown in FIG. 1 and in an enlarged manner.

FIG. 4 is a diagram showing a basic configuration of the achromatic unit 37 shown in FIG. 1 in an enlarged manner according to the present embodiment. FIG. 4 omits the illustration of the paper both-end convey devices 78. Regarding the heater-contact preventing mechanism 82, only heater-contact preventing wires 79*a* and 79*b* are shown in the figure.

It is already explained that the achromatic unit 37 shown in FIG. 4 is configured by the achromatic convey path 45, the heater units 47 arranged above and under the achromatic convey path 45 in a plane-symmetrical manner, and the light source units 48 arranged in the same manner as those of the heater units 47.

As shown in FIG. 4, the heater unit 47 includes a heat radiation heater 83 and a heater holding bracket 84. The light source unit 48 includes a light-source-unit frame 50 that runs in a direction orthogonal to the achromatic convey path 45, the LED light source 49 and a lens 51 held at the back side and the front side of the light-source-unit frame 50, respectively.

In the heater unit 47, the heat radiation plane (paper heating plane) 85 of the heat radiation heater 83 is formed to be substantially flat. The paper 41 conveyed in the achromatic convey path 45 receives radiation heat from a heat radiation plane 85 of the heat radiation heater 83 of the heater units 47 and is heated.

Together with heating, near-infrared ray is emitted from the LED light source 49 of the light source units 48 in an oblique direction. Accordingly, the achromatic toner image formed on the surfaces of the paper 41 can be achromatized efficiently.

The near-infrared ray absorbing colorant (dye or pigment) contained in the achromatic toner is mixed therewith since it is excited by absorbing near-infrared ray, is reacted with the achromatic agent, and becomes colorless. However, the near-infrared ray absorbing colorant in the toner binding agent resin hardly shows an achromatic reaction even if it absorbs near-infrared ray. Hence, it is effective if the near-infrared ray absorbing colorant is irradiated with near-infrared ray after heated, preferably, at the same time as being heated in order to cause such colorant to be colorless.

The achromatic light source is not limited to any particular kind as long as it can emit light at the absorption wavelength range of the near-infrared ray absorbing colorant. Preferably, if light of mainly wavelength of around 820 nm that is a first absorption band can be emitted, such light generally becomes efficient achromatic light.

Hence, as the light source of the present invention, an LED (Light Emitting Diode) is used which is an energy-saving light source. An example LED is an LED chip made by Alpha-one Electronics Ltd., (OP6-8510HP2) that can emit light with a center wavelength of 850 nm and a wavelength distribution at a half bandwidth of 30 nm.

Twelve such LED chips are arranged side by side in a direction orthogonal to the travel direction of the paper, and the lens 51 with a focal distance of 25 mm is arranged ahead of those LED chips, thereby configuring the LED light source 49 for achromatizing. The lens 51 is a linear Fresnel lens.

The LED light source 49 is arranged so as to be able to emit light to the paper 41 passing through the upper heater unit 47 and lower heater unit 47 at a width of about 40 mm by a distance about 150 mm. In order to efficiently emit achromatic light to the paper surface being heated by the heater units 47, the achromatic light is emitted to the paper from an oblique direction that is substantially 35 degrees relative to the achromatic convey path 45. It is preferable that the convey speed of the paper at this time should be equal to or faster than 15 mm/sec.

Figure 5A:
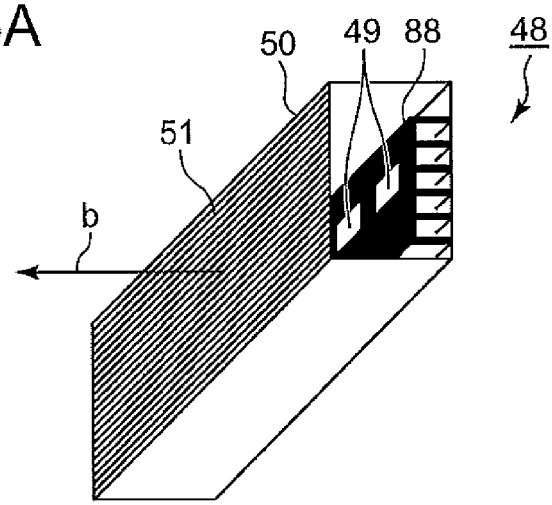
FIG. 5A is a perspective view showing a configuration of a light source unit of the achromatic unit according to the second embodiment of the present invention.
Figure 5B:
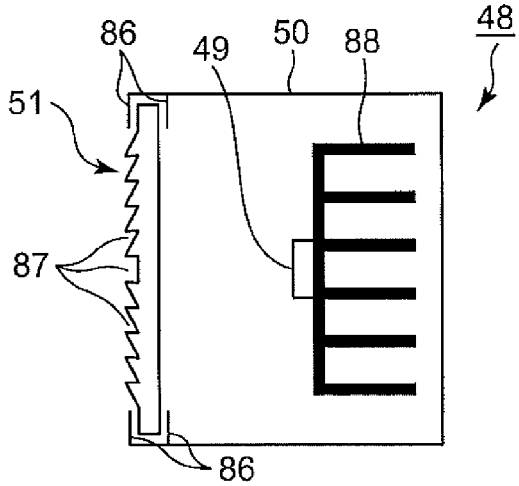
FIG. 5B is a side cross-sectional view of the light source unit.
Figure 5C:
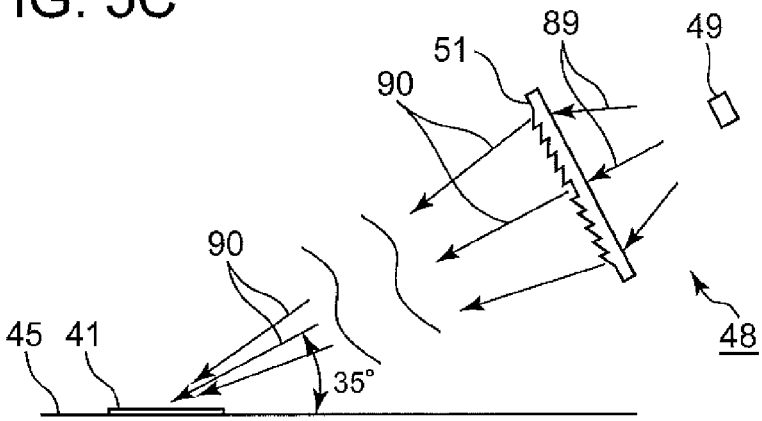
FIG. 5C is a diagram showing how achromatic light is emitted.

FIG. 5A is a perspective view showing the configuration of the light source unit 48 in more detail. FIG. 5B is a side cross-sectional view thereof, and FIG. 5C is a diagram showing how achromatic light is emitted.

As shown in FIGS. 5A and 5B, the light source unit 48 has upper and lower holders 86 at the front opening of the light-source-unit frame 50 having a U-shaped cross section in the figures. The lens 51 is held by the upper and lower holders 86, and is arranged so as to block off the whole opening of the light-source-unit frame 50.

The lens 51 is a linear Fresnel lens, and prism grooves 87 of the linear Fresnel lens are parallel to the lengthwise direction of the light-source-unit frame 50 of the light source unit 48.

In the present embodiment, the linear Fresnel lens formed of an inexpensive acrylic resin is used as the lens 51, but the present invention is not limited to such a kind. Any material including polycarbonate which has a superior thermal resistance can be used as long as it can be used for the Fresnel lens.

In FIGS. 5A and 5B, a light source base 88 is arranged on the internal surface opposite to the lens 51 blocking off the opening of the light-source-unit frame 50 and along the lengthwise direction of the light-source-unit frame 50. The plurality of LED light sources 49 are arranged side by side on the top surface of the light source base 88 along the lengthwise direction of the light-source-unit frame 50.

Since the light source unit 48 is used in the vicinity of the heat radiation heater 83, the light-source-unit frame 50 is arranged as an insulator wall that prevents the interior of the light source unit 48 from becoming a high temperature due to an external temperature of the light source unit 48 that becomes a high temperature.

The light source base 88 is provided also as a heat sink which surely prevents the LED light source 49 from being thermally affected from the exterior thereof and which diffuses self-generated heat since the light source of the present embodiment is a high-brightness, high-emission and high-output type LED. Needless to say, if an LED can relatively withstand against heat, a heat sink becomes unnecessary.

An arrow b shown in FIG. 5B indicates the emitted direction of parallel light. However, as shown in FIG. 5C, it is not true that parallel lights 89 emitted from the LED light source 49 are parallel to one another at all, and include widespread light.

However, all emitted lights after having passed through the lens 51 (linear Fresnel lens) become converged achromatic lights 90, and are emitted to the paper surface where the achromatic toner image is formed of the paper 41 conveyed through the achromatic convey path 45 of the achromatic unit 37. The light is obliquely emitted to the paper surface at an angle of substantially 35 degrees thereto.

Regarding the installation angle of the light source unit 48, a good result can be obtained within a range where the emitted light is inclined at 30 to 45 degrees relative to the paper surface. However, when the angle becomes large, the irradiation area becomes widespread and energy necessary for achromatizing can be reduced. On the other hand, when the angle becomes small, the irradiation intensity increases but the width of the irradiation area becomes small, so that the irradiation time while conveying the paper can be reduced. When the angle becomes further small, as a problem of installation, the distance from the heat source becomes close or the light source unit 48 contacts the heat source, and it is not preferable from the standpoint of heat insulation. Accordingly, it is preferable that the installation angle of the heat source unit 48 should be from 30 to 45 degrees, and the most efficient result can be obtained around 35 degrees.

Figure 6A:
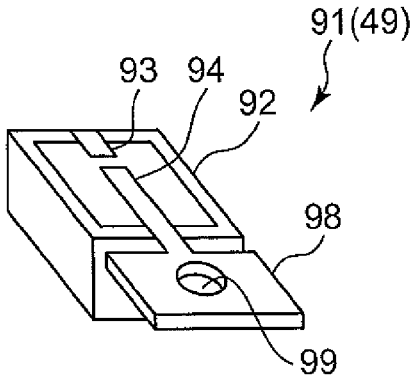
FIG. 6A is a perspective view showing a high-brightness reflective LED lamp used for an achromatic light source of the achromatic unit according to the second embodiment of the present invention.
Figure 6B:
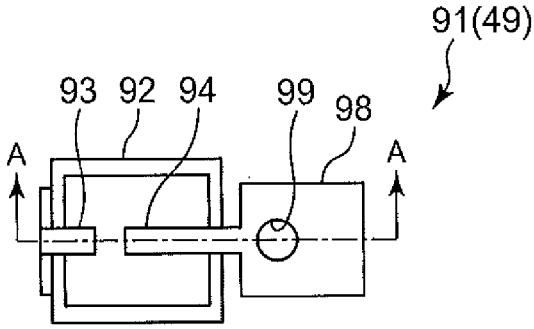
FIG. 6B is a plan view of the high-brightness reflective LED lamp.
Figure 6C:
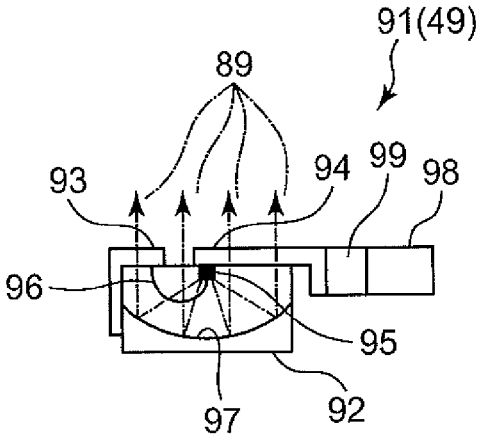
FIG. 6C is a cross-sectional view along a line A-A in FIG. 6B.
Figure 6D:
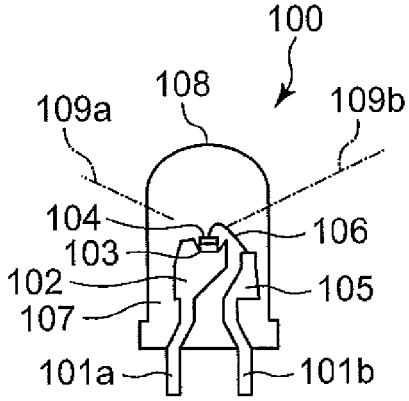
FIG. 6D (PRIOR ART)
FIG. 6D is a diagram showing, for comparison, a conventional bomb-shell-like LED lamp typically used.

FIGS. 6A to 6D are explanatory diagrams for an achromatic light source according to the present embodiment. FIG. 6A is a perspective view showing a high-brightness reflective LED lamp used for the achromatic light source, and FIG. 6B is a plan view thereof. FIG. 6C is a cross-sectional view along a line A-A, and FIG. 6D is a diagram showing, for comparison, a conventional bomb-shell-like LED lamp typically used.

A high-brightness reflective LED lamp 91 as the LED light source 49 and shown in FIGS. 6A to 6C includes a box 92, a cathode electrode terminal 93 and an anode electrode terminal 94 which thinly run to the center of the box 92 from respective side edges thereof through an opening, an LED element 95 fixed to the tip of the anode electrode terminal 94, an Au thin wire 96 that connects the LED element 95 to the cathode electrode terminal 93, and a reflective minor 97 arranged at the bottom of the box 92.

The high-brightness reflective LED lamp 91 further includes a lamp holder 98 integrated with a side end of the anode electrode terminal 94 opposite to an end thereof where the LED element 95 is fixed. A hole 99 for fixing the high-brightness reflective LED lamp 91 to a light source base to be discussed later by means of a screw is formed in the lamp holder 98.

When driven by both electrodes that are the cathode electrode terminal 93 and the anode electrode terminal 94 in order to emit light, the high-brightness reflective LED lamp 91 emits light emitted from the LED element 95 spreading in the bottom direction of the box 92 as the parallel light 89 slightly spreading in the opening direction of the box 92 by the reflective minor 97.

A bomb-shell-like LED lamp 100 conventionally used and shown in FIG. 6D includes two lead wires 101 (101*a* and 101*b*), a cathode electrode 102 connected to the one lead wire 101*a*, and an LED element 104 having one electrode fixed to the cathode electrode 102 by means of a conductive adhesive 103.

Furthermore, the LED lamp 100 includes an Au thin wire 106 having an end connected to an other electrode of the LED element 104 and having an other end connected to the anode electrode 105. The anode electrode 105 is integrally formed with an other lead wire 101*b*.

The LED lamp 100 has portions other than the two lead wires 101 (101*a* and 101*b*) among the above-explained configuration buried in an epoxy resin 107 and configures a bomb-shell-like LED lamp as a whole.

In general, the bomb-shell-like LED lamp 100 has a wide irradiation angle, and emitted light by light emission of the LED element 104 is emitted within a range of an irradiation angle that is an obtuse angle from an emission surface 108 of the epoxy resin 107 to spread widths 109*a* and 109*b*. The light use efficiency of such bomb-shell-like LED lamp 100 is 30 to 40%.

In contrast, the high-brightness reflective LED lamp 91 of the present invention causes substantially all light emitted from the LED element 95 to be reflected by the reflective minor 97 arranged at the bottom of the box 92, and emits such light which is controlled axially and close to parallel in comparison with the case of the bomb-shell-like LED lamp to the exterior.

Accordingly, the light use efficiency of equal to or greater than 90% can be obtained. That is why the high-brightness reflective LED lamp 91 is used as the achromatic light source according to the present embodiment.

The high-brightness reflective LED lamp 91 specifically used in the present embodiment is OP6-8510HP2 (made by Alpha-one Electronics Ltd.,) in consideration of the efficiency, but needless to say, the present invention is not limited to such a type as long as a necessary intensity at 850 nm can be obtained or a necessary light quantity can be obtained by increasing the number of LEDs.

Meanwhile, the heat radiation heater 83 is one of the units that consume power at most among the structural units of the achromatic apparatus 35. Hence, it is important to suppress the power consumption of the heat radiation heater 83 as much as possible and to efficiently heat the paper 41.

It is not illustrated in the figure but the achromatic apparatus 35 of the present invention uses a metal frame as the base of the main body of the achromatic apparatus. Such a frame is designed and configured to have an opening with an aperture ratio of 40 to 50% so that heat does not remain in the interior and the temperature thereof does not become a high temperature, and thus an air flow path is secured.

The heat radiation heater 83 according to the embodiment of the present invention is an infrastein B heater (an NGK-made ceramic heater) with a rating of 100 V and 200 W. Moreover, according to the heater units 47 shown in FIG. 4, three heat radiation heaters 83 are provided for each heater holding bracket 84. Accordingly, a total of six heat radiation heaters are provided for the upper heater unit 47 and lower heater unit 47.

The intended application of the achromatic apparatus 35 of the present embodiment is a general office use, and as shown in FIG. 1, can be combined with a printer that can perform printing using the achromatic toner. In consideration of a circumstance in which various devices like personal computers and electrical equipment are used in an office, it is necessary to suppress the whole power consumption of the printer and the achromatic apparatus to be, for example, equal to or smaller than 1500 W.

The achromatic operation needs substantially 1 KW, so that it is easily expected that the whole power consumption exceeds 1.5 KW including the printer. Hence, it is necessary to reduce the power consumption.

<Setting of Optimized Achromatic Condition>

Next, an explanation will be given of results of various tests carried out in order to obtain an achromatic apparatus which is capable of performing achromatizing an achromatic toner image at a low energy consumption and under an optimized achromatic condition.

First, in the printer 1 shown in FIG. 1, a recording medium (hereinafter, may be referred to as paper) as achromatizing evaluation paper for printing an achromatic toner R thereon which can be achromatized by the achromatic unit 37 was set to the paper feeding cassette 21. In this case, the paper may be general paper but in this example, P-paper (64 g/m$^2$) made by Xerox was used.

Next, the image forming unit 6R was set to the printer 1, and a patch that was a solid image of 1 cm by 1 cm by the achromatic toner R was printed on the paper through the same image forming procedures as those of a normal monochrome printing.

That is, a solid patch image of 1 cm by 1 cm by the achromatic toner R developed by the image forming unit 6R was transferred on the paper 41 from the intermediate transfer belt 14 in the secondary transfer unit, fixed on the paper 41 by the belt-scheme fixing device 27, and the paper 41 on which the achromatic toner image was fixed was ejected to the paper ejecting tray 29, thereby obtaining an achromatizing evaluation sheet (the paper 41).

According to the printing using the achromatic toner R, a bluish printing image was obtained. The initial concentration of the printed part of the patch of 1 cm by 1 cm for achromatizing evaluation and the chromatic coordinate thereof were measured using a spectroscopic concentration gauge (X-rite 938, made by U.S. Xrite Incorporated.), and a C-concentration was obtained. Next, the printed part of the patch was taken as a solid image with a C-concentration (before achromatizing) of around 0.8. Measurement was carried out under a measurement condition of X-rite 938 that was D65 and a status response: T.

Moreover, in order to observe the achromatized state together with the measurement of the value of the C-concentration, a text chart with a 10 font or so was printed and visually checked through the achromatizing evaluation.

Figure 7:
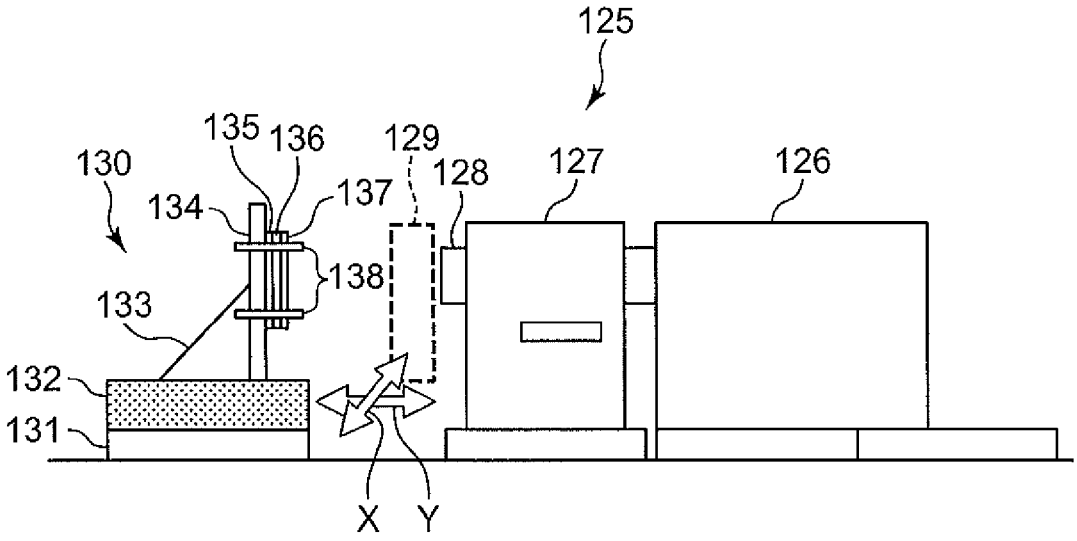
FIG. 7 is a diagram showing a simplified configuration of an irradiation tester that irradiates a printed object with light having a wavelength changed by a spectroscope in order to find the wavelength of an LED light source effective for achromatizing in an achromatic test according to the second embodiment of the present invention.

FIG. 7 is a diagram showing a simplified configuration of an irradiation tester for irradiating a printed object with light having a wavelength changed by a spectroscope in order to find the wavelength of an LED light source effective for achromatizing in an achromatic test.

In the irradiation tester 125 shown in FIG. 7, a variable wavelength light source 126 that was a halogen light source AT-100HG made by SHIMADZU Corporation and a spectroscope 127 that was a spectroscope SPG-120IR (4 mm of slit) were combined together in order to generate a wavelength having a specific wavelength as a peak.

Arranged at a light emitting opening 128 of the spectroscope 127 was a shutter unit 129 having a shutter and a control device that controlled the opening/closing of the shutter and integrated therewith. A sample holder 130 was arranged ahead of the light emitting direction.

The sample holder 130 includes a base 131, an XY stage 132 that was able to move on the base 131 in X and Y directions, a support member 133 that was a triangular plate fixed to the XY stage 132, a vertical plate 134, the rear surface thereof being fixed and supported by the support member 133, and a silicon rubber heater 136 (100 V, made by MISUMI Group Inc.,) fixed on the front surface (emitted light receiving surface) of the vertical plate 134 via a heat insulation plate 135.

In FIG. 7, a sample 137 had upper and lower sides attached to the front surface of the silicon rubber heater 136 by two string-like members 138. The sample 137 was the above-explained achromatizing evaluation sheet where a solid image having a C-concentration of around 0.8 before achromatizing was printed as a print sample on the patch portion of 1 cm by 1 cm in the paper 41.

The patch portion of the print sample on the sample 137 that was the achromatizing evaluation sheet held and fixed on the silicon rubber heater 136 was irradiated with light from the spectroscope 127. A distance from the light emitting opening 128 to the patch portion of the sample 137 was set to 5 cm, and an irradiation time was set to 60 seconds.

Figure 8:
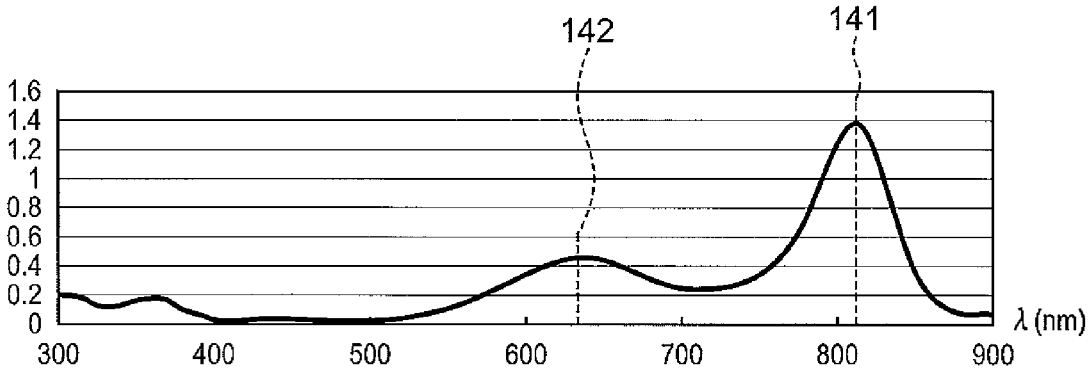
FIG. 8 is a characteristic diagram of a light absorption level regarding an infrared absorbing colorant in an achromatic toner used in the achromatic test according to the second embodiment of the present invention.

FIG. 8 is a characteristic diagram of a light absorption level regarding the infrared absorbing colorant in the achromatic toner R used in the test. The horizontal axis of the figure indicates a wavelength $\lambda$ (nm) and the vertical axis indicates an absorption level of the infrared absorbing colorant.

FIG. 8 also shows a light absorption level obtained through a silica cell using an ultraviolet-visible spectrophotometer (UV-2400PC made by SHIMADZU Corporation) when the infrared absorbing colorant was dissolved in methanol which was used as a reference. In the figure, a first absorption band 141 that is a first peak is 816 nm and a second absorption band 142 that is a second peak is 637 nm.

Figure 9:
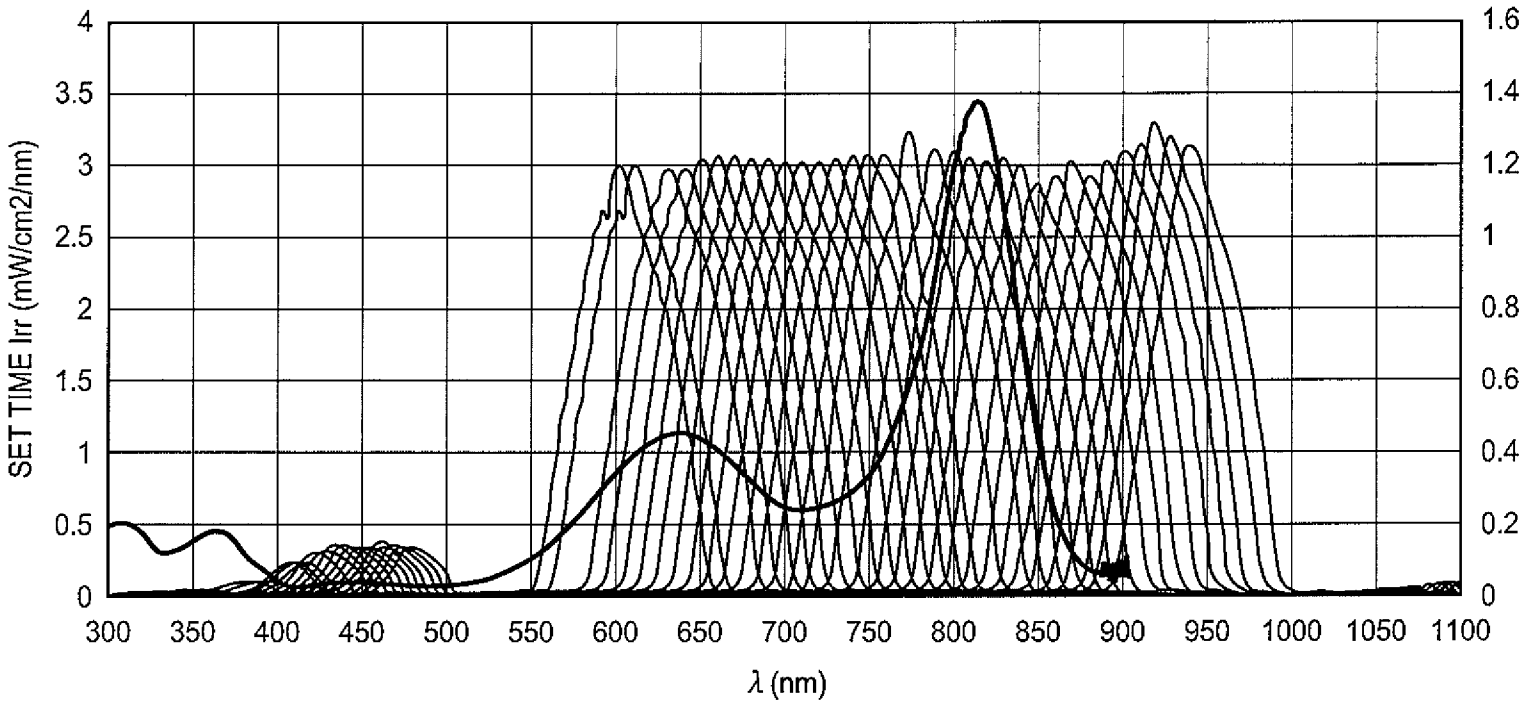
FIG. 9 is a characteristic diagram of each wavelength when the irradiation level of a variable light source is set to be constant regarding the light absorption level of the infrared absorbing colorant in the achromatic toner used in the achromatic test according to the second embodiment of the present invention.

The inventors of the present invention had a past knowledge that there is no problem if it is in the infrared absorption band or it is important to shift the peak of light to the peak of the first absorption band. According to this test, however, a test was carried out for an efficient achromatic wavelength in detail by checking the achromatic ability within a wavelength range from 600 nm to 950 nm, and a new knowledge was obtained FIG. 9 is a characteristic diagram of each wavelength when the irradiation level of the variable light source is set to be constant in the above-explained test. The horizontal axis in this figure also indicates a wavelength λ (nm) and a vertical axis indicates an absorption level of the infrared absorbing colorant. As shown in FIG. 9, regarding the intensity, other wavelengths were adjusted through a voltage to the maximum intensity at 600 nm so that the irradiation level became constant at respective peak wavelengths (600 nm to 950 nm).

Moreover, a half bandwidth of light was set to substantially 60 nm, and 50 nm which was roughly the half bandwidth of the emitted light of the LED light source 49 used as the light source shown in FIGS. 4 to 6C was set as a relatively close condition.

In order to assist the achromatic ability by heating at the time of achromatizing, the set temperature of the silicon rubber heater 136 behind the paper was set to 135 degrees Celsius, and a stable heating condition was maintained so that it becomes a temperature just ahead of the decomposition temperature of P3B that was the achromatic agent.

Figure 10:
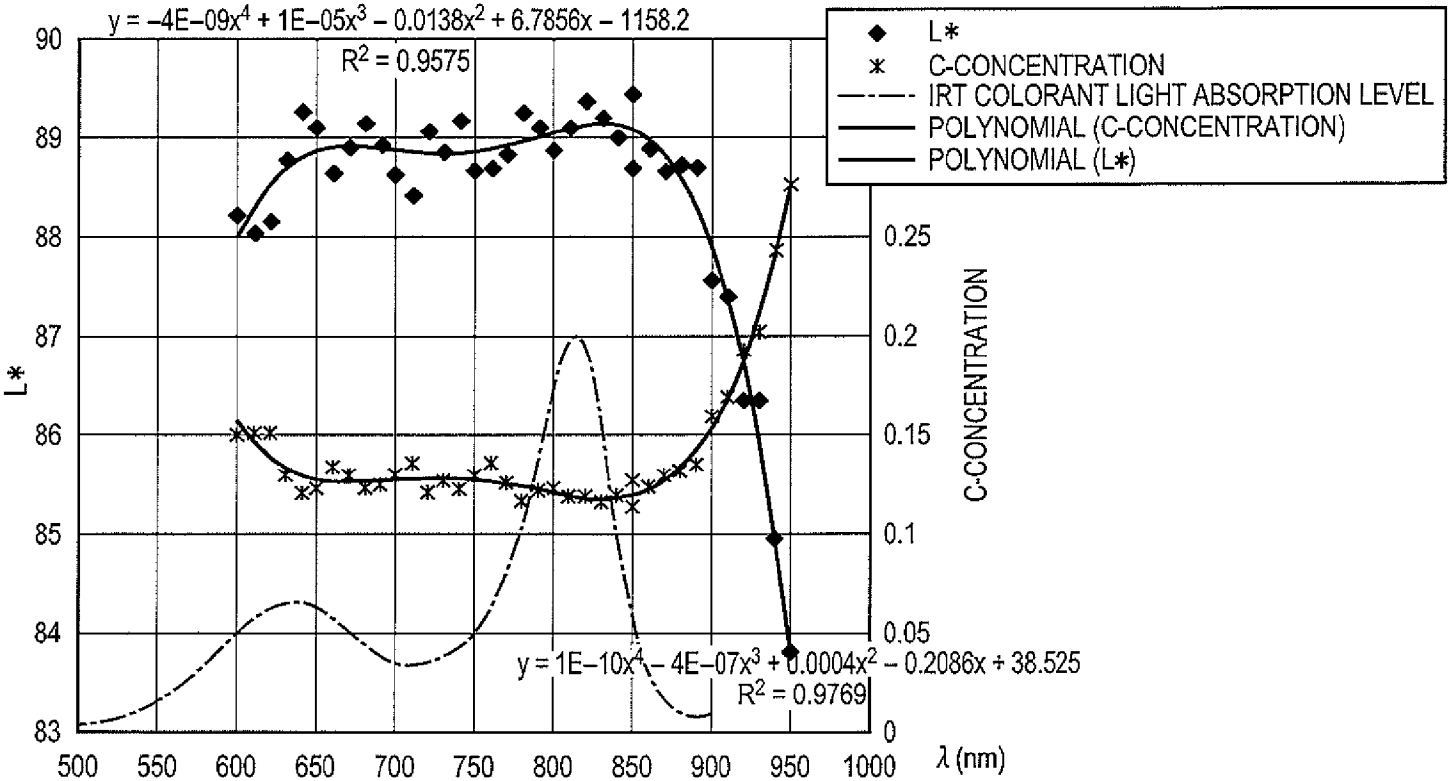
FIG. 10 is a graph showing an achromatic result for each wavelength in the achromatic test according to the second embodiment of the present invention.

FIG. 10 is a graph showing an achromatic result for each wavelength. The horizontal axis of the figure indicates a wavelength λ (nm) and the vertical axis indicates a value of L* in L*, a*, and b* coordinates where better achromatic ability appeared and a value of a C-concentration that was a concentration among values obtained by measuring a patch having undergone achromatizing by Xrite 938.

Based on the results of such numbers and the results of visual recognition, it becomes clear that a wavelength having a superior ability in a point that color remaining after achromatizing is little exists at the longer-wavelength side relative to 816 nm that is the center wavelength of the first absorption band.

FIG. 11 is a diagram showing a rate how much a near-infrared ray absorbing colorant and an achromatic wavelength are shifted to the long-wavelength side obtained based on a correlation coefficient. As is apparent from this diagram, the effect of the light-source wavelength relating to the light absorption level of a colorant is present at the long-wavelength side. That is, it is effective if the achromatic light source is set to be at the long-wavelength side from the center wavelength of the first absorption band.

Moreover, according to the result of visually checking an achromatic result at a distance of substantially 30 cm which is a normal distance to view a text, a result especially superior for achromatizing was obtained when light was emitted at a wavelength range from 820 to 850 nm.

Furthermore, as the sample 137 which showed the best achromatic ability, it was confirmed that one irradiated with light at a wavelength of around 830 to 840 nm showed the best achromatic ability.

Figure 12:
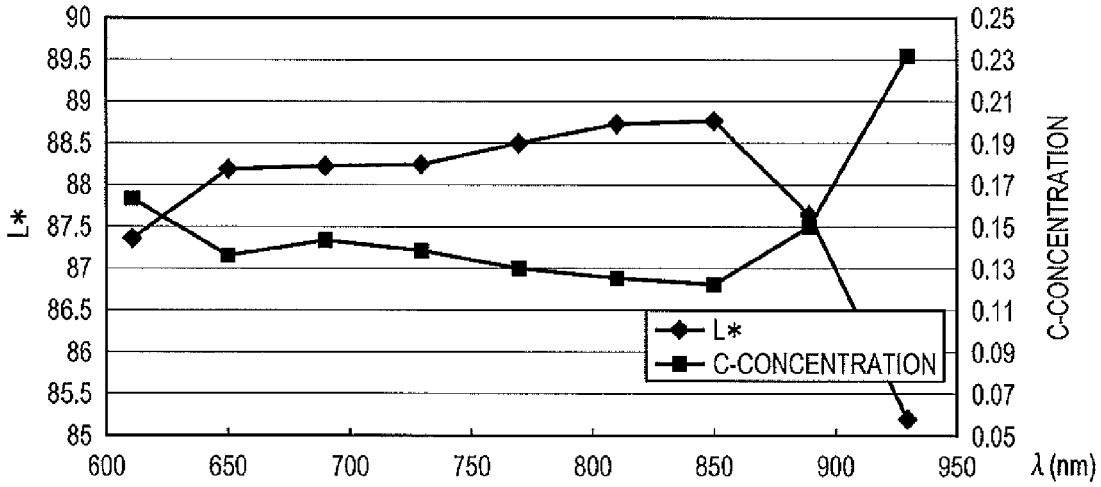
FIG. 12 is a graph showing a test result when a printing concentration (a value of C-concentration) is increased to 0.85 to 0.9 from substantially 0.8 and an achromatizing time is reduced.

FIG. 12 is a graph showing a test result when the print concentration that was C-concentration before achromatizing was increased from around 0.8 to substantially 0.85 to 0.9, and the achromatizing time was reduced. Like FIG. 10, the horizontal axis of FIG. 12 indicates a wavelength λ (nm) and the vertical axis thereof indicates a value of L* and a value of C-concentration that was the concentration among values obtained by measuring the patch having undergone achromatizing through Xrite 938.

As is clear from this result, the wavelength of around 830 to 850 nm is the effective wavelength that brings about the best achromatizing ability.

Based on the above-explained test result, in the example of the present invention, an infrastein B heater (a ceramic heater made by NGK) with a rating of 100 V and 200 W was used as the heat radiation heater 83 that is the achromatizing heat source of the achromatic unit 37 shown in FIG. 4, and an LED (OP6-8510HP2) made by Alpha-one Electronics Ltd., and emitting light with a wavelength distribution like the center wavelength was 850 nm and the half bandwidth was 30 nm was used as the light source that was an energy-saving light source.

Regarding the linear speed of the recording medium when conveyed, depending on the heater temperature but it is preferable that the linear speed should be equal to or faster than 15 mm/sec as a condition in which the toner achromatizing temperature is set to 140 degrees Celsius. In order to cause the temperature to reach near 140 degrees Celsius while the paper is conveyed through the achromatic convey path and the toner is irradiated with light from the light source, pieces of paper therearound become a temperature of near 200 degrees Celsius after achromatizing. Hence, the set value is decided in consideration of such situations.

As a result, it was determined that the temperature of the ceramic heater (the heat radiation heater 83) was preferably set to be a temperature so that the toner image on the paper was heated to near 140 degrees Celsius, and the LEDs (the high-brightness reflective LED lamp 91) of the LED array chip were preferably caused to emit light continuously at 900 mA, respectively.

That is, when the paper 41 that was a sample printed at a C-concentration of near 0.85 before achromatizing was fed at a linear speed of equal to or faster than 15 mm/sec, e.g., 20 mm/sec, and the achromatic ability was checked, it was verified that sufficient achromatizing was enabled relative to the sample being fed using an LED with a conditional wavelength obtained by waving the wavelength at a C-concentration of 0.10 after achromatizing and at L* of 89.39.

When a normal printing process was performed on the paper having undergone the achromatizing using the printer 1 shown in FIG. 1, it was possible to perform printing thereon while maintaining a good visibility of the next achromatic toner.

As explained above, according to the present embodiment, by selecting an LED having a good achromatic efficiency confirmed through the test, e.g., an LED having a wavelength shifted to the long-wavelength side from the absorption peak of the near-infrared ray absorbing colorant in the achromatic toner and having a peak within a wavelength range from 820 to 850 nm for example, an achromatic apparatus including an achromatic light source excellent in achromatizing can be realized at the same energy.

Moreover, since the LED is long life and has smaller power consumption than those of any other achromatic light sources and the ceramic heater is also long life, an extremely inexpensive achromatic apparatus from the standpoint of running cost can also be realized.

Furthermore, the achromatic toner is produced using a polyester-based resin obtainable by combining the near-infrared ray absorbing colorant that is a cyanine-based colorant with an organic boron-based compound, the absorption wavelength of the near-infrared ray absorbing colorant is checked and the LED with the optimized wavelength is selected, so that the maximum achromatic effect can be obtained.

<Third Embodiment>

Figure 13:
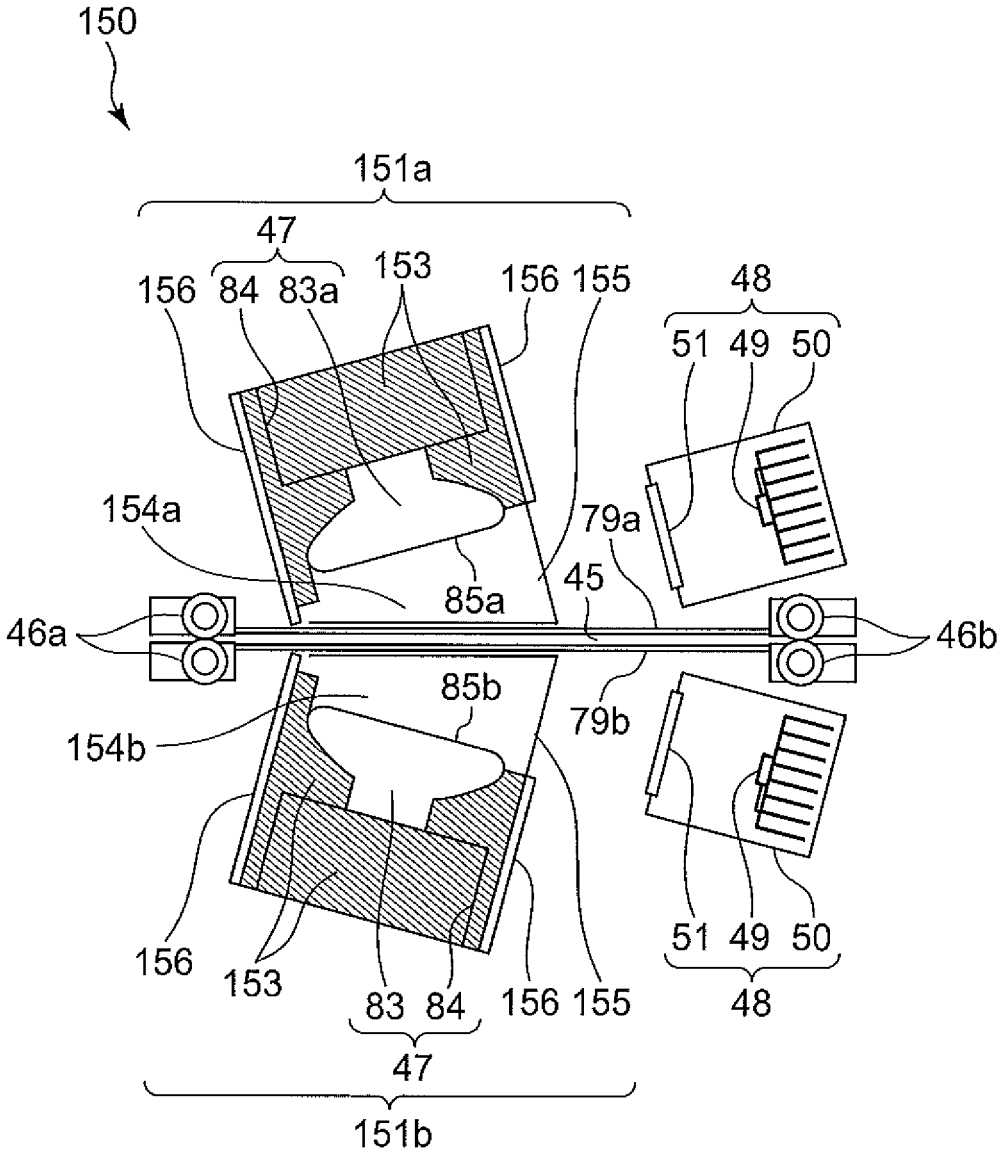
FIG. 13 is a cross-sectional view showing a heat insulation structure in an achromatic unit of an achromatic apparatus according to a third embodiment of the present invention.

FIG. 13 is a cross-sectional view showing a heat insulation structure in an achromatic unit 150 of an achromatic apparatus according to the present embodiment. The configuration of the whole achromatic apparatus is same as that of the achromatic apparatus 35 shown in FIG. 1, and the achromatic unit 150 employs the same basic configuration as that of the achromatic unit 37 shown in FIG. 4. Hence, the same structural element in FIG. 13 is denoted by the same reference numeral in FIGS. 1 and 4.

As shown in FIG. 13, the achromatic unit 150 of the achromatic apparatus of the present embodiment has a large modification in the heat radiation heater. That is, heat radiation heaters 151 (151*a* and 151*b*) each have a first heat insulator 153 that thermally shields portions other than the heat radiation plane 85 (85*a* and 85*b*) of the heat radiation heater 83 (83*a* and 83*b*) shown in FIG. 4 from the exterior.

The first heat insulator 153 is formed of, for example, a nonorganic fiber-based heat insulator. More specifically, a product name ISOWOOL (made by ISOLATE Insulating Products Co., Ltd.) is used. The ISOWOOL has a heatproof temperature of 1260 degrees Celsius and a thermal conductivity of 0.08 W/m·K. A bulk ISOWOOL and a sheet-type ISOWOOL with a thickness of 6 mm are separately used depending on the use location.

As a result, the first heat insulator 153 is formed as if the ISOWOOL is firmly applied to the outer surface of the heat radiation heater 151 other than the heat radiation plane (the heat radiation plane 85).

The first heat insulator 153 covers portions other than the heat radiation plane 85 of the heat radiation heater 83 so as not to be revealed to the exterior in order to suppress heat radiation from the surface of the heat radiation heater 83 other than the paper facing plane (the heat radiation plane 85) of the heat radiation heater 83 and a heat loss due to convection of heated air, thereby suppressing heat radiation and convection of air as minimum as possible.

Meanwhile, the heater holding bracket 84 is a metal, i.e., a good heat conductor, and becomes a high temperature since it directly holds the heat radiation heater 83. Accordingly, convection of air is also produced from this heater holding bracket 84. Accordingly, the surface of the heater holding bracket 84 is also covered by the first heat insulator 153.

Furthermore, the heat radiation heater 151 has a second heat insulator 155 that covers the surrounding other than the surrounding where the emitted achromatic light of the LED light source 49 passes through among the surrounding of an achromatic region 154 (154*a* and 154*b*) irradiated with radiation heat from the heat radiation heater 83 and the achromatic light from the light source unit 48. Since FIG. 13 is a cross-sectional view, the second heat insulator 155 located at the front side in the depthwise direction of the figure is not visible directly.

The second heat insulator 155 is a tabular member that is a tabular nonorganic fiber-based heat insulator for example. More specifically, a product name HIPHA (made by MISUMI Group Inc.,) is used. The type of HIPHA used is one having a heatproof temperature of 500 degrees Celsius, a thermal conductivity of 1.21 W/m·K and a thickness of 3 mm.

The second heat insulator 155 shields the achromatic region 154 from the exterior as much as possible in order to suppress heat loss due to convection of heated air at the achromatic region 154, thereby suppressing the convection of air as minimum as possible.

Moreover, heat loss is caused by thermal conduction at the connection portion between the heater holding bracket 84 and a non-illustrated main body frame. In order to suppress such thermal conduction, a heat-insulating support member 156 formed of a heat-insulating board is sandwiched between the heater holding bracket 84 and the main body frame, and then the heater holding bracket 84 is fixed to the main body frame.

Meanwhile, according to the above-explained configuration of the achromatic unit 150, regarding the shielding level of air to the achromatic region 154 from the exterior, it is not true that such a shielding level is perfect since the surrounding portion where the emitted achromatic light from the LED light source 49 passes through cannot be shielded so that the achromatic region 154 has an opening to the exterior.

Hence, if there is a member which allows near-infrared ray from the LED light source 49 to pass therethrough and which can withstand against heat, such a member may be arranged at the opening in order to increase the shielding level of the whole achromatic region 154. The inventors of the present invention keenly studied and found an appropriate member that is a silica glass.

The silica glass has a transmission factor of near-infrared ray including a wavelength of 850 nm that is the light emission wavelength of the LED light source 49 of the present embodiment which is substantially 95%. That is, the loss of the transmission factor of near-infrared ray can be suppressed to 5%. Moreover, the heatproof temperature of the silica glass is 1200 degrees Celsius. Note that no portion of the achromatic apparatus generates such a high temperature.

Hence, it was thought that the silica glass was a material that was able to sufficiently withstand the use in order to shield the opening of the achromatic unit from the standpoint of both light permeability and heat tolerance. Accordingly, the opening of the achromatic unit is shielded by the silica glass in the present embodiment.

Figure 14:
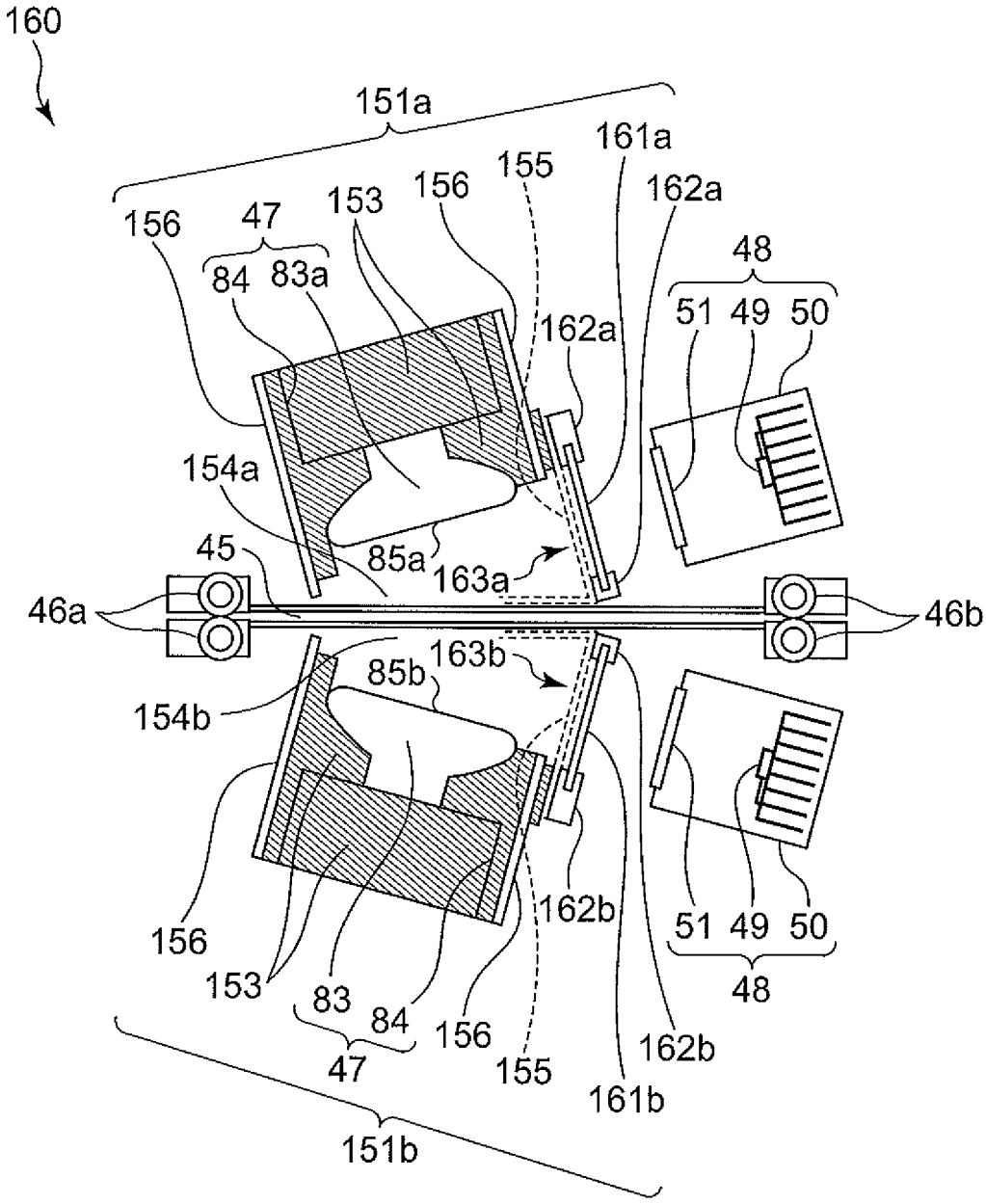
FIG. 14 is a cross-sectional view showing a heat insulation structure in an achromatic unit of an achromatic apparatus according to the third embodiment of the present invention.

FIG. 14 is a cross-sectional view showing a heat insulation structure in the achromatic unit of the achromatic apparatus according to the present embodiment. An achromatic unit 160 shown in the figure employs the same configuration as that of the achromatic unit 150 shown in FIG. 13 other than a silica glass plate 161 (161*a* and 161*b*) and a silica glass holding structure 162 (162*a* and 162*b*). Moreover, FIG. 14 shows an edge of the heat-insulating support member 156 by a dashed line.

As shown in FIG. 14, the achromatic unit 160 of the present embodiment has an opening 163 (163*a* and 163*b*) of the achromatic region 154 shielded from the exterior by the silica glass plate 161 (161*a* and 161*b*) held by the silica glass holding structure 162 (162*a* and 162*b*).

As the silica glass plate 161, specifically, a plate with a thickness of 2 mm and made of a natural silica glass (made by SHIN-ETSU Quartz products, Co., Ltd.,) is used. However, the silica glass is not limited to this type, and can be substituted with a member which satisfies both light permeability and heat tolerance, such as a product name PYREX (registered trademark) (made by SCHOTT AG), or a product name TEMPAX (made by Corning Glass).

FIG. 15 shows a measurement result of a heat-resistant glass transmissivity. Regarding the TEMPAX, one having a thickness of 3.3 mm was used. The silica glass and the TEMPAX were both placed in an achromatic tester and were usable without any problem. A heat-resistant glass can be used which has a transmissivity of equal to or larger than substantially 90% at around 800 nm, more preferably, equal to or larger than 92%, and further preferably, equal to or larger than 94%.

Regarding a measurement method, a reference side of an ultraviolet-visible spectrophotometer (UV-2400PC, made by SHIMADZU Corporation) was set as a blank, and a plate glass was set at the sample side, and wavelengths from 900 to 200nm were scanned.

Figure 15A:
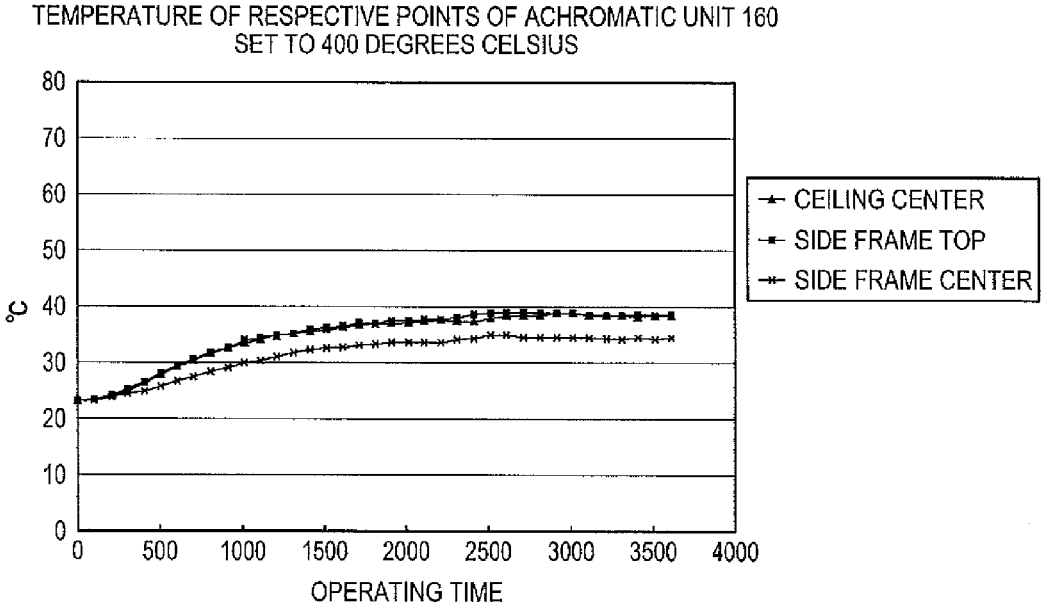
FIG. 15A is a graph showing a transition of a temperature at each of three temperature measuring fixed points in a metal flame when a control temperature is 400 degrees Celsius in the achromatic unit of the achromatic apparatus according to the third embodiment of the present invention.

FIG. 15A is a graph showing a transition of respective temperatures of three temperature measuring points of a metal frame in the configuration of the achromatic unit 160 shown in FIG. 14 at a control temperature of 400 degrees Celsius. As shown in FIG. 15A, respective points are all equal to or lower than 40 degrees Celsius, and are slightly lower temperature than the achromatic unit 37 of FIG. 4 (aperture ratio: 40 to 50%) and the achromatic unit 150 of FIG. 13, and thus a good result in temperature is obtained.

Figure 15B:
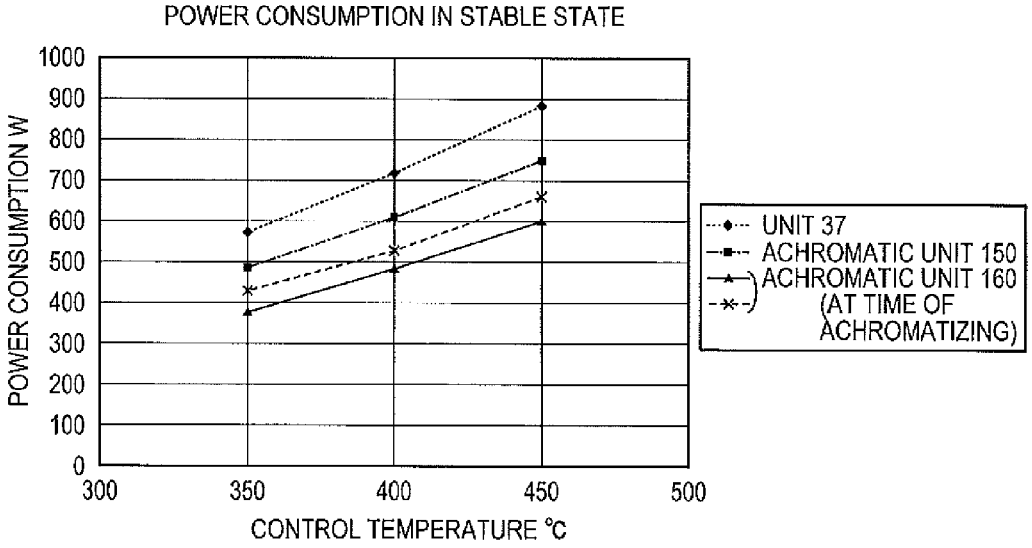
FIG. 15B is a graph showing power in a stable state when a control temperature is 350 degrees Celsius, 400 degrees Celsius, or 450 degrees Celsius while only a heater of the achromatic unit is in operation and while the achromatic unit is executing an achromatic process together with power in a stable state when only the heater according to the second and third embodiments is in operation.

FIG. 15B is a graph showing power of the achromatic unit 160 in a stable state when a control temperature is 350 degrees Celsius, 400 degrees Celsius, or 450 degrees Celsius while only a heater of the achromatic unit 160 is in operation and while the achromatic unit is executing an achromatic process together with power in a stable state when only the heaters of the achromatic unit 37 and the achromatic unit 150 are in operation.

In the graph shown in FIG. 15B, test values of the heater power consumption when only the heater unit was driven at a control temperature of 400 degrees Celsius were 483.4 W at the achromatic unit 160, 611.0 W at the achromatic unit 150, and 719 W at the achromatic unit 37 (aperture ratio: 40 to 50%).

That is, in comparison with the achromatic unit 37 and the achromatic unit 150 with a basic configuration, the value of heater power consumption becomes remarkably low. As explained above, according to the achromatic apparatus of the present embodiment, power consumption can be reduced by suppressing heat loss due to convection, radiation, and thermal conduction as minimum as possible, and a low-power-consumption apparatus can be configured, so that an image forming apparatus like a printer can be provided having an achromatic apparatus built therein and capable of being installed in an office.

<Fourth Example>

When the achromatic apparatuses of second and third embodiments are operated, the safeness is an important factor, and an explanation will be given of a fourth embodiment of the present invention which embodies an achromatic apparatus in consideration of the safeness.

Figure 16A:
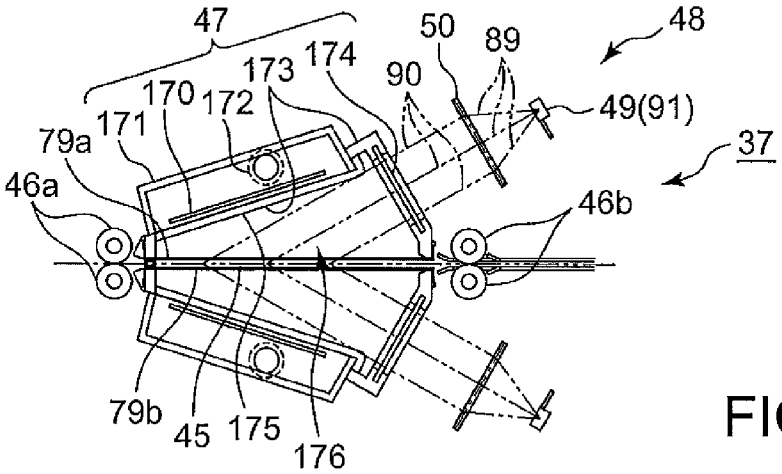
FIG. 16A is a side cross-sectional view showing a configuration of an achromatic unit according to a fourth embodiment of the present invention.
Figure 16B:
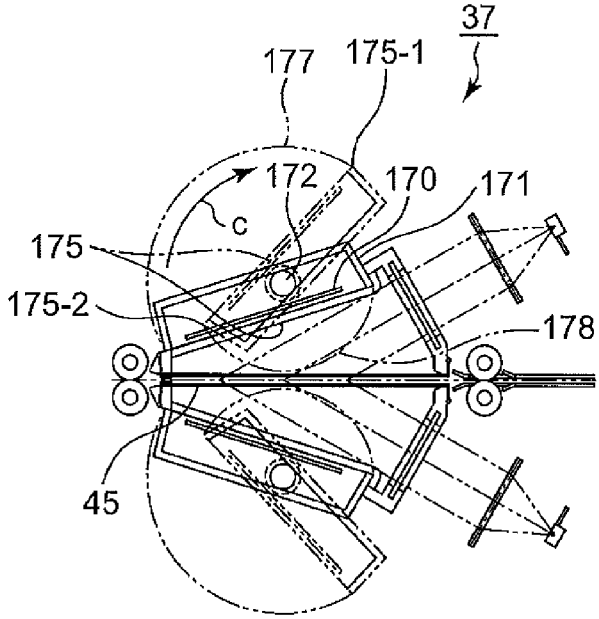
FIG. 16B is a diagram showing a rotation trajectory of a heat irradiation heater when heat irradiation is disabled.
Figure 16C:
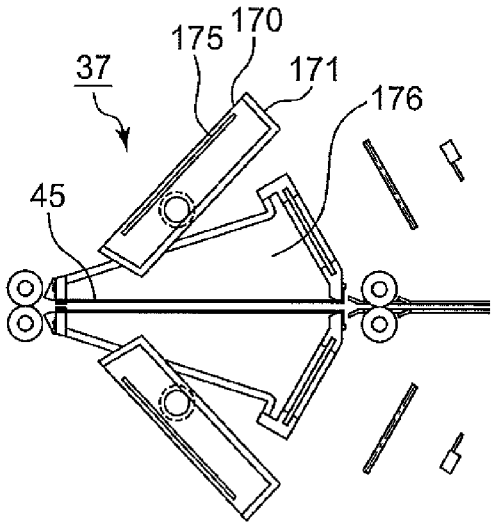
FIG. 16C is a diagram showing a rotation result of the heat irradiation heater.

FIG. 16A is a side cross-sectional view showing a configuration of the achromatic unit 37. FIG. 16B is a diagram showing a rotation trajectory of a heat irradiation heater of the achromatic unit when heat irradiation is disabled. FIG. 16C is a diagram showing a rotation result of the heat irradiation heater. The same structural element as that of FIG. 1, etc., will be denoted by the same reference numeral in FIG. 16A.

Regarding the convey mechanism in FIGS. 16A to 16C, the paper both-side convey devices 78 shown in FIGS. 2 and 13 are unillustrated, and only the paper convey roller pairs 46 (46*a* and 46*b*) and the heater-contact preventing wire 79 (79*a* and 79*b*) shown in the plan view of FIG. 13 are shown.

The heater units 47 and the light source units 48 of the achromatic unit 37 shown in FIGS. 16A to 16C are configured so as to be arranged in a plane-symmetrical up and down relative to the achromatic convey path 45. Accordingly, only the heater unit 47 and the light source unit 48 arranged above the achromatic convey path 45 will be explained.

The illustration of the light source unit 48 is simplified in the figures, and the explanation for such a configuration will be omitted. Accordingly, the explanation will be given of the heater unit 47 in detail.

The heater unit 47 includes a heat radiation heater 170 (a ceramic heater is also used in the present embodiment), a heater cover 171, and a heater supporting shaft 172 which is cylindrical and which supports a heater configured by the heat radiation heater 170 and the heater cover 171.

Moreover, the heater unit 47 includes a heat-insulating cover 173, and a heat-resistant glass plate 174 which is held at an opening formed in the heat-insulating cover 173 in a direction orthogonal to the paper convey direction.

The heat radiation heater 170 is arranged in the vicinity of the achromatic convey path 45 in an inclined state so as to have one end (the left in the figure) closer to the convey path and an other end (the right in the figure) farther from the convey path. The heat radiation heater 170 heats the print surface of the achromatic toner image on the paper conveyed from the upstream side of the achromatic convey path 45 to the downstream side thereof.

The heater cover 171 shields and reflects radiation heat radiated in directions other than a heat radiation plane 175 directed to the achromatic convey path 45 among radiation heat radiated in all four directions from the heat radiation heater 170, and collects radiation heat from the heat radiation heater 170 in the direction of the heat radiation plane 175 without a loss.

It is not clearly illustrated in FIGS. 16A to 16C since those are cross-sectional views, but the heat-insulating cover 173 covers the whole circumference of a heat radiation space 176 that is an achromatic unit from a side face of the heat radiation heater 170 to a side space of the achromatic convey path 45 in order to block off an effect from the open air by the convection of air, and prevents heat in the achromatic unit from escaping into the exterior.

Furthermore, the heat-insulating cover 173 serves as a holding member that holds the heat-resistant glass plate 174 in the emitted light path of the achromatic light 90 from the light source unit 48. The heat-resistant glass plate 174 can be preferably formed of the silica glass explained in the third embodiment.

In this fashion, the heat radiation space 176 of the heat radiation heater 170 surrounded by the heater cover 171, the heat-insulating cover 173 and the heat-resistant glass plate 174 is caused to suppress convection of air into the exterior, and thus forming an achromatic unit having less heat loss and a good thermal efficiency.

The heater supporting shaft 172 fixing and supporting the heater cover 171 is arranged so as to support the heat radiation heater 170 via the heater cover 171 at a position toward an other end (an end distant from the achromatic convey path 45, i.e., the right end in the figure) side rather than the center of the heat radiation heater 170.

Meanwhile, when the paper 41 is being heated by the heat radiation heater 170 through the achromatic convey path 45, a defect (or a failure) that makes continuation of the achromatic process unable may occur. Such defect includes a paper jamming, an unexpected false operation of the power cut switch.

When such a defect or a failure occurs and the paper 41 is left for a certain time while being stacked in the heating region (the heat radiation space 176) in achromatizing operation, the paper 41 may change the color thereof and there is a risk of smoking.

When the above-explained defect occurs, in the present embodiment, an unillustrated sensor control unit is notified of such a defect. Based on this notification, a control unit rotates and controls the heater supporting shaft 172 through an unillustrated support shaft rotating unit, and rotates the heat radiation heater 170 so that the heat radiation plane 175 thereof faces in a different direction from at least the plane of the achromatic convey path 45.

That is, as shown in FIG. 16B, the support shaft rotating unit rotates and drives the heater supporting shaft 172 so that a heater configured by the heat radiation heater 170 and the heater cover 171 rotates in the clockwise direction in the figure indicated by an arrow c.

At this time, since the heater supporting shaft 172 supports the heater at an other end side 175-2 of the heat radiation heater 170 (hereinafter, also means the heat radiation plane 175) rather than the center thereof, one end 175-1 of the heat radiation heater 170 rotates while tracing a large rotation trajectory 177 in a space opposite to the achromatic convey path 45.

Conversely, the other end 175-2 of the heat radiation heater 170 rotates so as not to contact the achromatic convey path 45 and trace a small arc that is a rotation trajectory 178 along the achromatic convey path 45. As a result, as shown in FIG. 16C, the heat radiation heater 170 has the heat radiation plane 175 rotated so as to face the opposite side to the achromatic convey path 45.

As explained above, in the achromatic unit, i.e., the heat radiation space 176, when a defect or a failure occurs, such as a paper jamming or an unexpected false operation of the power cut switch, heat radiation from the heater units 47 that is a heat source to the heat radiation space 176 is instantaneously disabled. Accordingly, the color change of the paper and the smoking therefrom due to continuation of the heat radiation can be avoided.

In particular, in the case of a paper jamming, the heat radiation to the achromatic unit can be disabled without turning off of the power of the heat radiation heater, so that there is an effect that the achromatic unit can be returned to an appropriate temperature right after the canceling of the paper jamming, and the achromatic operation can be restarted.

Having described and illustrated the principles of this application by reference to one or more preferred embodiments, it should be apparent that the preferred embodiments may be modified in arrangement and detail without departing from the principles disclosed herein and that it is intended that the application be construed as including all such modifications and variations insofar as they come within the spirit and scope of the subject matter disclosed herein.

What is claimed is:

1. An achromatic apparatus comprising an achromatic unit that includes, in order to achromatize an achromatic toner image formed on at least one surface of a recording medium using an achromatic toner, a heating unit and a light emitting unit, wherein the achromatic toner includes a near-infrared ray absorbing colorant which is a cyanine-based colorant, and an organic boron-based compound, and wherein:

the achromatic unit further includes a convey path where the recording medium formed with the achromatic toner image on at least one surface thereof is conveyed at a predetermined speed, the heating unit includes a pair of heat radiation heaters that heat the achromatic toner image on at least one surface of the recording medium conveyed through the convey path to a temperature at which the achromatic toner image is effectively achromatized, the light emitting unit includes LED array chips as a pair of light sources having a center wavelength within a wavelength range from 820 to 850 nm, the pair of heat radiation heaters are arranged so as to face one another such that the pair of heat radiation heaters are: (i) located in a vicinity of the convey path, (ii) arranged obliquely to a direction in which the recording medium is conveyed, and (iii) arranged across the convey path so that a first end of each of the pair of heat radiation heaters on an upstream side of the direction in which the recording medium is conveyed is relatively closer to the convey path and a second end of each of the pair of heat radiation heaters on a downstream side of the direction in which the recording medium is conveyed is relatively farther from the convey path, and the pair of light sources are arranged on the downstream side of the pair of heat radiation heaters in the direction in which the recording medium is conveyed, and are arranged so as to face one another across the convey path, wherein optical axes of the pair of light sources are obliquely arranged to emit, from a second end side of each of the pair of heat radiation heaters, light to the recording medium on which the achromatic toner image is formed on at least one surface and which is being heated by the heat radiation heater so as to achromatize the achromatic toner image formed on one or both surfaces of the recording medium.

2. The achromatic apparatus according to claim 1, wherein each of the pair of heat radiation heaters comprises a ceramic heater which heats the achromatic toner image on at least one surface of the recording medium conveyed through the convey path to a temperature of about 140 degrees Celsius.

3. The achromatic apparatus according to claim 1, wherein the center frequency of the LED array chip of each light source is shifted to a long-wavelength side from a peak of a first absorption band of the near-infrared ray absorbing colorant.

4. The achromatic apparatus according to claim 1, further comprising a convey unit that conveys the recording medium through the convey path at a linear speed of at least 15 mm/sec.

5. An achromatic apparatus comprising:

a pair of heat radiation heaters which are arranged across a convey path that conveys a recording medium at a predetermined speed in order to achromatize at least one achromatic toner image formed on one or both surfaces of the recording medium by heating surfaces of the recording medium on which the at least one achromatic toner image is formed;

a pair of light sources which are arranged across the convey path at a downstream side of a conveying direction of the recording medium with respect to the pair of heat radiation heaters, wherein the pair of light sources obliquely emit light to the at least one surface of the recording medium on which the at least one achromatic toner image is formed, and which is heated by the pair of heat radiation heaters;

a plurality of first heat-insulating members which thermally shield portions of the pair of heat radiation heaters other than heat radiation planes of the pair of heat radiation heaters;

a plurality of second heat-insulating members that shield surroundings other than surroundings of regions where the emitted light from the pair of light sources passes through achromatic regions irradiated with heat radiation from the pair of heat radiation heaters; and a plurality of heat-resistant translucent glass plates which are arranged facing the pair of light sources, which are provided at openings of the achromatic regions where the emitted light from the pair of light sources passes, which transmit the emitted light, and which thermally shield the achromatic regions from an exterior together with the second heat-insulating member.

6. The achromatic apparatus according to claim 5, wherein each of the pair of light sources comprises an LED array chip having a center wavelength within a wavelength range from 820 to 850 nm, and wherein the LED array chip emits light to the at least one achromatic toner image on the recording medium, which is heated to a temperature of around 140 degrees Celsius and is being conveyed through the convey path.

7. The achromatic apparatus according to claim 5, wherein the plurality of first heat-insulating members are formed of a nonorganic fiber-based heat-insulating material, and are firmly applied to external surfaces of the pair of heat radiation heaters other than the heat radiation planes so as to surround the heat radiation heaters.

8. The achromatic apparatus according to claim 5, wherein each second heat-insulating member comprises a tabular member that is a nonorganic fiber-based heat-insulating material.

9. The achromatic apparatus according to claim 1, further comprising:

a plurality of support shafts that support the pair of heat radiation heaters; and a plurality of support shaft rotating units which rotate and control the plurality of support shafts to rotate the pair of heat radiation heaters so that a heat radiation plane of each of the pair of heat radiation heaters is directed in a different direction from a plane of the convey path when a defect that disables continuation of an achromatic process occurs while the recording medium is being heated by the pair of heat radiation heaters along the convey path.

10. The achromatic apparatus according to claim 9, wherein the defect includes a paper jamming, a blackout, and a false operation of a power cut switch.

11. The achromatic apparatus according to claim 9, wherein the plurality of support shafts support the pair of heat radiation heaters at positions toward the second end sides with respect to centers of the pair of heat radiation heaters, and wherein the plurality of support shaft rotating units rotate the support shafts so that rotation trajectories of the second ends of the pair of heat radiation heaters draw arcs along the convey path and the heat radiation planes are directed to opposite sides from the convey path when the defect occurs.

* * * * *